US011131940B2

(12) United States Patent
Sakamoto et al.

(10) Patent No.: US 11,131,940 B2
(45) Date of Patent: Sep. 28, 2021

(54) TONER FOR DEVELOPING ELECTROSTATIC CHARGE IMAGE, ELECTROSTATIC CHARGE IMAGE DEVELOPER, AND TONER CARTRIDGE

(71) Applicant: FUJI Business Innovation Corp., Tokyo (JP)

(72) Inventors: Shinya Sakamoto, Kanagawa (JP); Shinya Nakashima, Kanagawa (JP); Masaki Iwase, Kanagawa (JP); Tomohiro Shinya, Kanagawa (JP); Ryutaro Kembo, Kanagawa (JP); Tomohito Nakajima, Kanagawa (JP); Naomi Miyamoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/783,111

(22) Filed: Feb. 5, 2020

(65) Prior Publication Data

US 2020/0310271 A1 Oct. 1, 2020

(30) Foreign Application Priority Data

Mar. 26, 2019 (JP) ..... JP2019-057795

(51) Int. Cl.
*G03G 9/087* (2006.01)
*G03G 15/08* (2006.01)

(52) U.S. Cl.
CPC ..... *G03G 9/08755* (2013.01); *G03G 15/0865* (2013.01)

(58) Field of Classification Search
CPC ..... G03G 9/08755; G03G 9/08797
See application file for complete search history.

(56) References Cited

U.S. PATENT DOCUMENTS

| | | | | |
|---|---|---|---|---|
| 2009/0181317 A1 | 7/2009 | Moriya | | |
| 2017/0242358 A1 * | 8/2017 | Kawamura | ..... | G03G 9/0825 |

FOREIGN PATENT DOCUMENTS

| | | | | |
|---|---|---|---|---|
| JP | 2002182427 | | 6/2002 | |
| JP | 2004151438 | | 5/2004 | |
| JP | 2009-133937 | * | 6/2009 | ..... G03G 9/08 |
| JP | 2015-114364 | | 6/2015 | |
| JP | 2017-146568 | | 8/2017 | |
| WO | 2006035862 | | 4/2006 | |

OTHER PUBLICATIONS

Translation of JP 2009-133937.*

* cited by examiner

*Primary Examiner* — Peter L Vajda
(74) *Attorney, Agent, or Firm* — JCIPRNET

(57) ABSTRACT

A toner for developing an electrostatic charge image includes a binder resin. In dynamic viscoelasticity measurement, a storage modulus $G'_{50T}$ of the toner at 50° C. is $2\times10^6$ Pa or more and $3\times10^8$ Pa or less, a storage modulus $G'_{100T}$ of the toner at 100° C. is $1\times10^4$ Pa or more and $1\times10^6$ Pa or less, and tan $\delta_T$ of the toner in an entire temperature range of 50° C. or more and 100° C. or less is 0.05 or more and 1.5 or less.

6 Claims, 3 Drawing Sheets

TONER FOR DEVELOPING ELECTROSTATIC CHARGE IMAGE, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2019-057795 filed Mar. 26, 2019.

BACKGROUND

(i) Technical Field

The present disclosure relates to a toner for developing an electrostatic charge image, an electrostatic charge image developer, and a toner cartridge.

(ii) Related Art

In an image forming apparatus, an image is formed by transferring a toner image formed on an image carrier onto a surface of a recording medium, and then fixing the toner image to the recording medium by using a fixing member that contacts the toner image and applies heat, pressure, etc., to the toner image.

Japanese Unexamined Patent Application Publication No. 2002-182427 discloses one example of a toner used in such an image forming apparatus. Specifically, this patent document discloses a toner for developing an electrostatic charge image, the toner including particle aggregates obtained by aggregating at least a polymer primary particles and coloring agent primary particles, in which the value of the viscoelastic tan δ in the temperature range of 100° C. to 200° C. is in the range of 0.1 to 2.

Japanese Unexamined Patent Application Publication No. 2004-151438 discloses a toner used in an image forming method that includes a fixing step of fixing an unfixed toner image onto a recording medium by: using a fixing unit that includes at least a heating metal sleeve, which has a flexible cylindrical metal tube as a base layer, a heating member that contacts and heats an inner surface of the heating metal sleeve, and a rotatable pressing member that is in press-contact with the heating member with the heating metal sleeve therebetween and has a rotation axis parallel to the heating metal sleeve; and causing the recording medium having the unfixed image thereon to pass through a fixing nip part formed between the heating metal sleeve and the pressing member in press-contact with each other. This toner contains at least a binder resin, a coloring agent, and wax. The maximum endothermic peak of this toner in the endothermic curve obtained by measurement with a differential scanning calorimeter (DSC) is in the range of 60° C. to 135° C., the temperature at which the loss modulus G" is $3\times10^4$ Pa is in the range of 90° C. to 115° C., the temperature at which the loss modulus G" is $2\times10^4$ Pa is in the range of 95° C. to 120° C., and the temperature at which the loss modulus G" is $1\times10^4$ Pa is in the range of 105° C. to 135° C.

International Publication No. 2006/035862 discloses a toner for developing an electrostatic charge image, the toner containing at least a binder resin and a coloring agent, in which the binder resin contains an amorphous resin and a crystalline resin. This toner has an endothermic peak having a start temperature of 100° C. to 150° C., the onset temperature of the end point of the endothermic peak is in the range of 150° C. to 200° C. as measured by increasing the temperature with a differential scanning calorimeter, and there exists a half width in the range of 10° C. to 40° C.

Japanese Unexamined Patent Application Publication No. 2017-146568 discloses a toner containing a binder resin and a releasing agent, in which, when a desired molecular weight M is selected from the molecular weight range of 300 or more and 5,000 or less in a GPC molecular weight distribution of the THF soluble components in the toner, the difference between the maximum value and the minimum value of the peak intensities (relative values obtained by assuming the value of the maximum intensity in a molecular weight range of 20,000 or less to be 100 in a molecular weight distribution curve obtained by plotting the intensity in the vertical axis versus the molecular weight in the horizontal axis in GPC measurement) in the range of the molecular weight M ±300 is 30 or less. In addition, according to this toner, the ratio (P930/P828) of the intensity of the peak (930 $cm^{-1}$) of the bisphenol A ethylene oxide adduct (BPA-EO) to the intensity of the peak (828 $cm^{-1}$) of the binder resin as determined by a Fourier transform infrared spectrometry-attenuated total reflection (FTIR-ATR) method is 0.20 or more and 0.40 or less. Furthermore, the toner does not have a peak P995 (995 $cm^{-1}$) of the bisphenol A propylene oxide adduct (BPA-PO).

Japanese Unexamined Patent Application Publication No. 2015-114364 discloses a toner containing toner base particles, in which the toner base particles contain a polyester resin (A) insoluble in tetrahydrofuran (THF), the toner base particles have a crystalline resin (B) on outermost surfaces, the tetrahydrofuran (THF) insoluble fraction of the toner exhibits a glass transition temperature [Tglst(THF insoluble fraction)] of −50° C. or more and 20° C. or less during the first temperature elevation process in a differential scanning calorimetry (DSC), and the storage modulus [G'(THF insoluble fraction)] of the THF insoluble fraction of the toner at 40° C. or more and 120° C. or less as measured with a rheometer is $1.0\times10^5$ Pa or more and $3.0\times10^7$ Pa or less.

SUMMARY

In an image forming apparatus, when a recording medium is being conveyed by a conveying roll, timing mismatch may occur between two ends of the recording medium and the recording medium may thereby become twisted. Due to this twisting of the recording medium, small breakage or deformation may occur in the image, resulting in image roughening and degradation of image quality.

Aspects of non-limiting embodiments of the present disclosure relate to a toner for developing an electrostatic charge image with which occurrence of image roughening is suppressed compared to when the storage modulus $G'_{50T}$ at 50° C. is less than $2\times10^6$ or more than $3\times10^8$, when the storage modulus $G'_{100T}$ at 100° C. is less than $1\times10^4$ or more than $1\times10^6$, or when tan $\delta_T$ is less than 0.05 or more than 1.5 at some temperature in the range of 50° C. or more and 100° C. or less.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a toner for developing an electrostatic charge image, the toner including a binder resin. In dynamic viscoelasticity measurement, a storage modulus $G'_{50T}$ of the toner at 50° C. is $2\times10^6$ Pa or more and $3\times10^8$ Pa or less, a storage modulus $G'_{100T}$ of the toner at 100° C. is $1\times10^4$ Pa or more and $1\times10^6$ Pa or less, and tan $\delta_T$ of the toner in an entire temperature range of 50° C. or more and 100° C. or less is 0.05 or more and 1.5 or less.

BRIEF DESCRIPTION OF THE DRAWINGS

Exemplary embodiments of the present disclosure will be described in detail based on the following figures, wherein.

DETAILED DESCRIPTION

Figure 1:
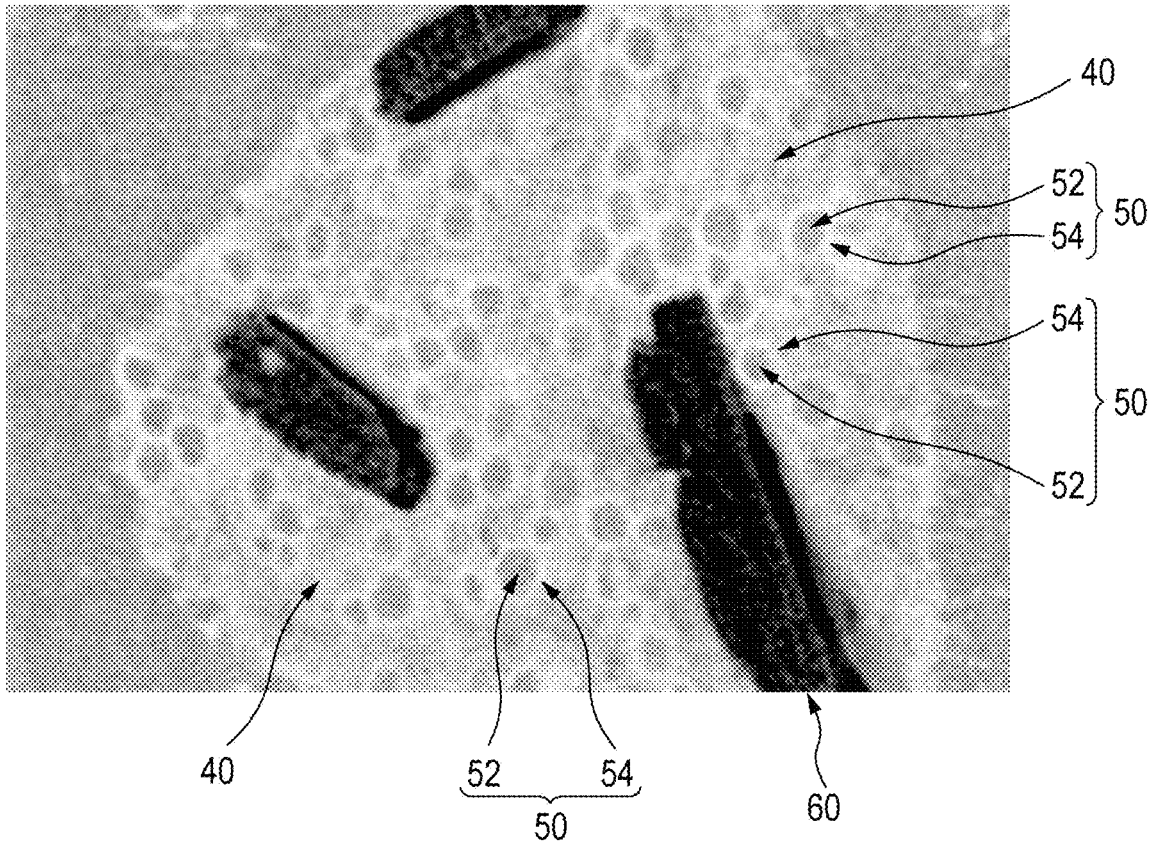
FIG. 1 is a cross-sectional image of one example of a toner according to an exemplary embodiment.

Exemplary embodiments of the present disclosure will now be described.

Toner for Developing Electrostatic Charge Image

A toner for developing an electrostatic charge image (hereinafter may be simply referred to as the "toner") according to an exemplary embodiment contains at least a binder resin. According to this toner, in dynamic viscoelasticity measurement, the storage modulus $G'_{50T}$ at 50° C. is $2\times10^6$ Pa or more and $3\times10^8$ Pa or less, the storage modulus $G'_{100T}$ at 100° C. is $1\times10^4$ Pa or more and $1\times10^6$ Pa or less, and tan $\delta_T$ in the entire temperature range of 50° C. or more and 100° C. or less is 0.05 or more and 1.5 or less.

In an image forming apparatus, a recording medium is conveyed from a recording medium storage to a toner image transfer unit and a toner image fixing unit via a conveying roll. During this process, timing mismatch in conveying may occur between two ends of the recording medium in a direction orthogonal to the recording medium conveying direction, in which case the recording medium that is being conveyed becomes twisted. Such mismatch tends to occur more frequently as the function of the image forming apparatus becomes simpler (for example, as the price of the image forming apparatus becomes lower). Due to twisting of the recording medium, small breakage or deformation may occur in the image, resulting in image roughening and degradation of image quality.

The image roughening caused by this twisting of the recording medium tends to be more extensive when a thin recording medium (for example, a sheet of paper having a basis weight of 60 g/m$^2$ or less) is used since a thin sheet of paper is more susceptible to twisting. When the image has a small printed area, such as an image with characters only, twisting of the recording medium has a small impact on the image; however, when the image has a large printed area (such as when the image is a solid image), twisting of the recording medium has a large impact on the image, and the image roughening tends to be extensive.

In contrast, the toner according to the exemplary embodiment having the aforementioned features suppresses occurrence of image roughening even when the recording medium becomes twisted during conveying.

The reason behind this is presumably as follows.

When the storage modulus $G'_{50T}$ at 50° C. exceeds $3\times10^8$ Pa, in other words, when $G'_{50T}$ is excessively high and thus the toner is excessively hard, the image cannot follow the twisting of the recording medium, and the fixed image tends to have small breakages, resulting in image roughening. When $G'_{50T}$ is less than $2\times10^6$ Pa, the toner is excessively soft, and thus the fixed image tends to minutely deform, resulting in image roughening.

When the storage modulus $G'_{100T}$ at 100° C. is less than $1\times10^4$ Pa, the toner excessively penetrates the recording medium during fixing, and the toner image is strongly affected by the twisting of the recording medium, resulting in small breakages in the image and image roughening. When the storage modulus $G'_{100T}$ exceeds $1\times10^6$ Pa, penetration of the toner into the recording medium is insufficient during fixing, and the image fixing strength is degraded, resulting in breakage caused by twisting of the recording medium, and image roughening.

In addition to controlling $G'_{50T}$ and $G'_{100T}$ as described above, tan $\delta_T$ in the entire temperature range of 50° C. to 100° C. is controlled to suppress occurrence of image roughening. Here, tan $\delta_T$ is the ratio of the loss modulus relative to the storage modulus of the toner in the entire temperature range of 50° C. or more and 100° C. or less. When tan $\delta_T$ exceeds 1.5, the dominant property of the toner is viscosity, and thus the image strength is degraded, image breakage occurs due to twisting of the recording medium, and image roughening occurs. When tan $\delta_T$ is less than 0.05, the dominant property of the toner is elasticity, and thus the bonding force to the recording medium is degraded and the fixing strength is degraded, resulting in breakage caused by twisting of the recording medium, and image roughening.

In contrast, in this exemplary embodiment, the storage modulus $G'_{50T}$ at 50° C., the storage modulus $G'_{100T}$ at 100° C., and tan $\delta_T$ in the entire temperature range of 50° C. or more and 100° C. or less are respectively set to be in the aforementioned ranges so that even when the recording medium has become twisted during conveying, occurrence of small breakages and deformation in the image is suppressed, and thus the image roughening is suppressed.

Storage Modulus $G'_{50T}$ of Toner at 50° C.

The storage modulus $G'_{50T}$ of the toner of this exemplary embodiment at 50° C. in dynamic viscoelasticity measurement is $2\times10^6$ Pa or more and $3\times10^8$ Pa or less. From the viewpoint of facilitating suppression of image roughening, $G'_{50T}$ is preferably $6\times10^6$ Pa or more and $1\times10^8$ Pa or less and more preferably $1\times10^7$ Pa or more and $1\times10^8$ Pa or less.

Storage Modulus $G'_{100T}$ of Toner at 100° C.

The storage modulus $G'_{100T}$ of the toner of this exemplary embodiment at 100° C. in dynamic viscoelasticity measurement is $1\times10^4$ Pa or more and $1\times10^6$ Pa or less. From the viewpoint of facilitating suppression of image roughening, $G'_{100T}$ is preferably $1\times10^4$ Pa or more and 1×105 Pa or less and more preferably $1\times10^4$ Pa or more and $5\times10^4$ Pa or less.

Tan $\delta_T$ of the Toner in the Entire Temperature Range of 50° C. or More and 100° C. or Less Tan $\delta_T$ of the toner of this exemplary embodiment in dynamic viscoelasticity measurement in the entire temperature range of 50° C. or more and 100° C. or less is 0.05 or more and 1.5 or less.

From the viewpoint of suppressing image roughening for a long period of time, tan $\delta_T$ is preferably 0.05 or more and 0.5 or less and more preferably 0.1 or more and 0.4 or less since this can suppress contamination of the fixing roll with the toner for a long period of time.

Meanwhile, from the viewpoint of maintaining stable image gloss irrespective of the temperature, tan $\delta_T$ is preferably 0.6 or more and less than 1.0 or less and more preferably 0.7 or more and 0.9 or less.

From the viewpoint of suppressing gloss nonuniformity, tan $\delta_T$ is preferably 1.0 or more and 1.5 or less and more preferably 1.1 or more and 1.3 or less since, in this range, the peelability of the fused toner to the fixing roll is maintained while an appropriate degree of viscoelasticity that generates sufficient wettability to the sheet and sufficient deformability is exhibited.

Dynamic viscoelasticity measurement of the toner will now be described.

The loss tangent tan $\delta_T$ (in other words, the dynamic loss tangent of the dynamic viscoelasticity) of the toner in dynamic viscoelasticity measurement is defined by G"/G' where G' is the storage modulus and G" is the loss modulus obtained by measuring the dependency of dynamic viscoelasticity on temperature. Here, G' is the elastic response component of the elastic modulus with respect to the stress-strain relationship, and the energy relative to the deformation work is stored. The viscous response component of the elastic modulus is G". Moreover, tan $\delta_T$ defined by G"/G' also serves as a standard for the ratio of the energy loss and storage relative to the deformation work.

The dynamic viscoelasticity measurement is performed with a rheometer.

Specifically, the toner to be measured is formed into a tablet by using a press molding machine at room temperature (for example, 25° C.) so as to prepare a measurement sample. This measurement sample is subjected to dynamic viscoelasticity measurement by using a rheometer under the following conditions to obtain a storage modulus curve and a loss modulus curve, and then the storage modulus $G'_{50T}$ at 50° C., the storage modulus $G'_{100T}$ at 100° C., and tan $\delta_T$ in the entire temperature range of 50° C. or more and 100° C. or less are obtained from these curves.

Measurement Conditions

Measurement instrument: Rheometer ARES (produced by TA Instruments)

Measurement jig: 8 mm parallel plates

Gap: adjusted to 4 mm

Frequency: 1 Hz

Measurement temperature: elevating temperature from 25° C. to a highest attained temperature of 150° C.

Strain: 0.03 to 20% (automatic control)

Temperature elevation rate: 1° C./min

The methods for controlling the storage modulus $G'_{50T}$, the storage modulus $G'_{100T}$, and tan $\delta_T$ of the toner are not particularly limited.

For example, the method for controlling the storage modulus $G'_{50T}$ and the storage modulus $G'_{100T}$ may involve adjusting the storage moduli G' of the binder resin in the toner at 50° C. and 100° C., and adjusting the amount of the binder resin. When two or more binder resins are used, the ratio between the amounts of respective binder resins, and the storage moduli G' of the respective binder resins at 50° C. and 100° C. may be adjusted. When at least one of the binder resins forms domains, the particle diameter of the domains may be adjusted.

The method for controlling tan $\delta_T$ of the toner may involve adjusting the storage modulus G' and the loss modulus G" of the binder resin in the toner in the entire temperature range of 50° C. or more and 100° C. or less, adjusting the amount of the binder resin, determining presence or absence of the tetrahydrofuran (THF) insoluble fraction, and adjusting the amount of the tetrahydrofuran (THF) insoluble fraction. When two or more binder resins are used, the ratio between the amounts of respective binder resins, and the storage modulus G' and loss modulus G" of the respective binder resins in the entire temperature range of 50° C. or more and 100° C. or less may be adjusted, for example. When at least one of the THF insoluble fraction and at least one of the binder resins forms domains, the particle diameter of the domains may be adjusted.

From the viewpoint of controlling the storage modulus $G'_{50T}$, the storage modulus $G'_{100T}$, and tan $\delta_T$ of the toner to be within the aforementioned ranges, the toner of the exemplary embodiment may have a structure in which a discontinuous phase containing a binder resin is scattered in a continuous phase containing a binder resin. In other words, the toner may have a sea-island structure formed of the continuous phase corresponding to the sea and the discontinuous phase corresponding to islands (domains).

Examples of the toner having a sea-island structure include toners having the following two structures.

(1) Toner having a structure formed of a continuous phase containing a binder resin (i) and a discontinuous phase having a core containing a binder resin (ii) and a coating layer coating the core and containing a binder resin (iii)

(2) Toner having a structure containing a binder resin and a tetrahydrofuran (THF) insoluble fraction that constitutes a discontinuous phase (1) Toner Having a Structure Formed of a Continuous Phase and a Discontinuous Phase Having a Core and a Coating Layer One example of the toner having the structure (1) described above will now be described.

FIG. 1 is a cross-sectional image of one example of a toner according to an exemplary embodiment and having the structure (1) described above. A toner illustrated in FIG. 1 contains a continuous phase 40 containing a binder resin (i) and a discontinuous phase 50 scattered in the continuous phase 40. The discontinuous phase 50 has a core 52 that contains a binder resin (ii) and a coating layer 54 that covers the core 52 and contains a binder resin (iii). In other words, the continuous phase 40 corresponding to the sea and the discontinuous phase 50 corresponding to islands (domains) form a sea-island structure, and each of the islands of the discontinuous phase 50 has a structure that has a core 52 and a coating layer 54 around the core 52. The toner illustrated in FIG. 1 contains a releasing agent 60.

Binder Resins Contained in Continuous Phase, Core, and Coating Layer

The binder resin (i) contained in the continuous phase, the binder resin (ii) contained in the core, and the binder resin (iii) contained in the coating layer may be the same resin or different resins.

Here, "different resins" may be, for example, resins that have different constitutional units in polymer chains (for example, resins synthesized by using, as starting materials, monomers having different molecular structures) or resins having the same constitutional units in the polymer chain but different average molecular weights.

Binder Resin (i) Contained in Continuous Phase

The continuous phase may contain, as a binder resin (i), a crystalline resin and an amorphous resin. Incorporation of a crystalline resin in the continuous phase tends to improve low-temperature fixability. From the viewpoint of improving the low-temperature fixability, the continuous phase more preferably contains a crystalline polyester resin and an amorphous polyester resin. (In the description below, a crystalline polyester resin contained in the continuous phase is referred to as a resin "a" and an amorphous polyester resin contained in the continuous phase is referred to as a resin "b1".)

The mass ratio of the crystalline resin to the amorphous resin in the continuous phase (more preferably, the mass ratio (a/b1) of the crystalline polyester resin a to the amorphous polyester resin b1) is preferably 0.04 or more and 1.0 or less, more preferably 0.09 or more and 0.6 or less, and yet more preferably 0.1 or more and 0.4 or less.

When the mass ratio of the crystalline resin to the amorphous resin (more preferably, the mass ratio (a/b1) of the crystalline polyester resin a to the amorphous polyester resin b1) is 0.04 or more, the low-temperature fixability tends to be improved. At a ratio of 1.0 or less, the fixing strength of the image tends to be increased.

The crystalline resin and the amorphous resin contained in the continuous phase may each be one resin or two or more resins. The crystalline polyester resin a and the amorphous polyester resin b1 contained in the continuous phase may each be one resin or two or more resins.

With respect to all binder resins contained in the continuous phase, the total content of the crystalline polyester resin a and the amorphous polyester resin b1 is preferably 50 mass % or more, more preferably 80 mass or more, and yet more preferably 100 mass %.

Binder Resin (ii) Contained in Core

The core may contain, as a binder resin (ii), an amorphous resin (more preferably, an amorphous polyester resin).

As described below, when the glass transition temperature Tg of the binder resin (iii) contained in the coating layer is lower than the fixing temperature, the core may further contain an amorphous resin (more preferably, an amorphous polyester resin). The amorphous resin in the core fuses and leaks out from the discontinuous phase during fixing, and thus the fixing strength of the image can be easily increased. (In the description below, an amorphous polyester resin contained in the core is referred to as a resin "b2".)

From the viewpoint of improving fixing strength of the image, the mass ratio of the amorphous resin contained in the core (more preferably, an amorphous polyester resin b2) to the binder resin (i) contained in the continuous phase (preferably a crystalline resin and an amorphous resin and more preferably a crystalline polyester resin a and an amorphous polyester resin b1) (more preferably, the mass ratio [b2/(a+b1)] of the amorphous polyester resin b2 relative to the total of the crystalline polyester resin a and the amorphous polyester resin b1) is preferably 0.01 or more and 0.6 or less, more preferably 0.02 or more and 0.3 or less, and yet more preferably 0.03 or more and 0.1 or less.

The amorphous resin (more preferably, the amorphous polyester resin b2) contained in the core may be one resin or two or more resins.

With respect to all binder resins contained in the core, the content of the amorphous polyester resin b2 is preferably 50 mass % or more, more preferably 80 mass % or more, and yet more preferably 100 mass %.

Binder Resin (iii) Contained in Coating Layer

The binder resin (iii) contained in the coating layer may be a binder resin having a different constitutional unit in polymer chains than those of the binder resin (i) contained in the continuous phase and the binder resin (ii) contained in the core. When the binder resin (iii) contained in the coating layer is a resin having a different constitutional unit in polymer chains than those of the binder resins contained in the continuous phase and the core, a structure (also known as a sea-island structure) having a continuous phase and a discontinuous phase having a core and a coating layer coating the core can be easily formed.

The binder resin (iii) contained in the coating layer may form chemical bonds to the binder resin (ii) contained in the core at the interface between the core and the coating layer. When chemical bonds between the binder resins are formed, a structure (also known as a sea-island structure) having a continuous phase and a discontinuous phase having a core and a coating layer coating the core can be easily formed.

As mentioned above, the binder resin (iii) contained in the coating layer may have a different constitutional unit in polymer chains than those of the binder resin (i) and the binder resin (ii), and may form chemical bonds with the binder resin (ii) at the interface between the core and the coating layer. From the viewpoint of facilitating formation of a structure (also known as a sea-island structure) having a continuous phase and a discontinuous phase having a core and a coating layer coating the core, the binder resin (iii) contained in the coating layer may have low compatibility with the binder resins (i) and (ii).

From such a viewpoint, when the continuous phase contains a crystalline polyester resin a and an amorphous polyester resin b1 and the core contains an amorphous polyester resin b2, the coating layer may contain a vinyl resin. (In the description below, a vinyl resin contained in the coating layer is referred to as a resin "c".)

The glass transition temperature Tg of the binder resin (iii) contained in the coating layer (more preferably, a vinyl resin c) may be lower than the fixing temperature (the set temperature during fixing in the image forming apparatus). When the glass transition temperature Tg of the binder resin (iii) (more preferably, a vinyl resin c) is lower than the fixing temperature, the amorphous resin in the core fuses and leaks out from the discontinuous phase during fixing, and thus the fixing strength of the image can be easily increased.

From the viewpoint of increasing the fixing strength of the image, the glass transition temperature Tg of the binder resin (iii) contained in the coating layer is preferably −70° C. or more and 40° C. or less, more preferably −50° C. or more and 30° C. or less, and yet more preferably −40° C. or more and 20° C. or less.

The glass transition temperature Tg of the binder resin (iii) is determined from a DSC curve obtained by differential scanning calorimetry (DSC). More specifically, the glass transition temperature is determined from the "extrapolated glass transition onset temperature" described in the method for determining the glass transition temperature in JIS K 7121-1987 "Testing Methods for Transition Temperatures of Plastics".

The binder resin (more preferably, a vinyl resin c) contained in the coating layer may be one resin or two or more resins.

With respect to all binder resins contained in the coating layer, the vinyl resin c content is preferably 50 mass % or more, more preferably 80 mass % or more, and yet more preferably 100 mass %.

Relationship Between Binder Resin (i) Contained in Continuous Phase and Binder Resin (ii) Contained in Core When the continuous phase contains, as the binder resin (i), an amorphous resin (more preferably, an amorphous polyester resin b1) and the core contains, as the binder resin (ii), an amorphous resin (more preferably, an amorphous polyester resin b2), the amorphous resins contained in the continuous phase and the core (more preferably, the amorphous polyester resins b1 and b2) may be the same resin or different resins.

When the glass transition temperature Tg of the binder resin (iii) contained in the coating layer (more preferably, a vinyl resin c) is lower than the fixing temperature, the amorphous resins (more preferably, amorphous polyester resins b1 and b2) contained in the continuous phase and the core may have high compatibility with each other. When the compatibility between these resins is high, the amorphous resin in the core fuses and leaks out from the discontinuous phase during fixing, and mixes with the amorphous resin in the continuous phase. Thus, the fixing strength of the image can be easily increased.

From the viewpoint of increasing the compatibility, the amorphous resin contained in the continuous phase and the amorphous resin contained in the core (more preferably, the amorphous polyester resins b1 and b2) may be resins that have only identical constitutional units in polymer chains (for example, the resins may be synthesized by using only monomers having the same molecular structures as the starting materials for the resins).

The constitutional units in polymer chains in a resin can be analyzed by NMR.

The method for forming a structure having a continuous phase and a discontinuous phase having a core and a coating layer is not particularly limited. One example of the method is the following aggregation and coalescence method.

First, a resin particle dispersion of an amorphous polyester resin b2 having unsaturated double bonds is prepared. Thereto, a vinyl monomer and an initiator are added to induce a reaction so as to produce a composite resin particle dispersion having a core containing the amorphous polyester resin b2 and a coating layer covering the core and containing the vinyl resin c. Since the amorphous polyester resin b2 has unsaturated double bonds, chemical bonds are formed between the amorphous polyester resin b2 and the vinyl resin c at the interface between the core and the coating layer.

A toner is then prepared by the aggregation and coalescence method by using this composite resin particle dispersion, a separately prepared resin particle dispersion of an amorphous polyester resin b1 and a separately prepared resin particle dispersion of a crystalline polyester resin a. As a result, a toner having a structure formed of a continuous phase and a discontinuous phase having a core and a coating layer is obtained.

Methods for Controlling $G'_{50T}$, $G'_{100T}$ and Tan $\delta_T$

For the toner having the structure (1) above, examples of the methods for controlling the storage modulus $G'_{50T}$, the storage modulus $G'_{100T}$ and tan $\delta_T$ includes the following methods.

Examples of the method for controlling the storage modulus $G'_{50T}$ of the toner include methods that involve adjusting the content and the storage modulus G' at 50° C. of the crystalline resin (preferably the crystalline polyester resin A) contained in the continuous phase, adjusting the storage modulus G' at 50° C. of the amorphous resin (preferably the amorphous polyester resin b1) contained in the continuous phase, and adjusting the content and the storage modulus G' at 50° C. of the amorphous resin (preferably the amorphous polyester resin b2) contained in the core.

Examples of the method for controlling the storage modulus $G'_{100T}$ of the toner include methods that involve adjusting the content and the storage modulus G' at 100° C. of the crystalline resin (preferably the crystalline polyester resin A) contained in the continuous phase, adjusting the storage modulus G' at 100° C. of the amorphous resin (preferably the amorphous polyester resin b1) contained in the continuous phase, adjusting the content and the storage modulus G' at 100° C. of the amorphous resin (preferably the amorphous polyester resin b2) contained in the core, and adjusting the particle diameter (specifically, the average equivalent circle diameter) of the discontinuous phase having a core and a coating layer and the thickness of the coating layer.

Examples of the method for controlling tan $\delta_T$ of the toner include methods that involve adjusting the content of the crystalline resin (preferably the crystalline polyester resin A) contained in the continuous phase and the storage modulus G' and the loss modulus G" thereof in the entire temperature range of 50° C. or more and 100° C., adjusting the storage modulus G' and the loss modulus G" of the amorphous resin (preferably the amorphous polyester resin b1) contained in the continuous phase in the entire temperature range of 50° C. or more and 100° C. or less, adjusting the content of the amorphous resin (preferably, the amorphous polyester resin b2) contained in the core and the storage modulus G' and the loss modulus G" thereof in the entire temperature range of 50° C. or more and 100° C. or less, and adjusting the particle diameter (specifically, the average equivalent circle diameter) of the discontinuous phase having a core and a coating layer and the thickness of the coating layer.

In particular, the storage modulus $G'_{50T}$, the storage modulus $G'_{100T}$ and tan $\delta_T$ of the toner can be easily controlled to be within the aforementioned ranges when the storage modulus G' and the loss modulus G" of the crystalline resin (preferably, the crystalline polyester resin A) contained in the continuous phase in the entire temperature range of 50° C. or more and 100° C. or less is adjusted to be different from the storage modulus G' and the loss modulus G" of the amorphous resin (preferably, the amorphous polyester resin b1) contained in the continuous phase in the entire temperature range of 50° C. or more and 100° C. or less.

G' and Tan δ of Resins

In the toner that has the structure (1) above, ranges of the storage modulus G' and the loss tangent tan δ of each of the resins contained in the continuous phase, the core, and the coating layer may be as follows.

[1] Crystalline Resin (Preferably, Crystalline Polyester Resin a) Contained in Continuous Phase From the viewpoint of controlling the storage modulus $G'_{50T}$ at 50° C. of the toner to be within the aforementioned range, the storage modulus $G'_{50a}$ at 50° C. of the crystalline resin (preferably, the crystalline polyester resin a) contained in the continuous phase in dynamic viscoelasticity measurement is preferably $1\times10^6$ Pa or more and $1\times10^9$ Pa or less and more preferably $1\times10^7$ Pa or more and $1\times10^8$ Pa or less.

From the viewpoint of controlling the storage modulus $G'_{100T}$ at 100° C. of the toner to be within the aforementioned range, the storage modulus $G'_{100a}$ at 100° C. of the crystalline resin (preferably, the crystalline polyester resin a) contained in the continuous phase in dynamic viscoelasticity measurement is preferably $1\times10^{-1}$ Pa or more and $1\times10^2$ Pa or less and more preferably $1\times10^0$ Pa or more and $1\times10^1$ Pa or less.

From the viewpoint of controlling tan $\delta_T$ of the toner in the entire temperature range of 50° C. or more and 100° C. or less to be within the aforementioned range, tan $\delta_a$ of the crystalline resin (preferably, the crystalline polyester resin a) contained in the continuous phase in the entire temperature range of 50° C. or more and the melting temperature of the crystalline resin or less in dynamic viscoelasticity measurement is preferably 0.01 or more and 1.0 or less and more preferably 0.05 or more and 0.5 or less.

The melting temperature of the crystalline resin is preferably 50° C. or more and 100° C. or less, more preferably 55° C. or more and 90° C. or less, and yet more preferably 60° C. or more and 85° C. or less.

The melting temperature is determined from a DSC curve obtained by differential scanning calorimetry (DSC) by the method described in "Melting peak temperature", which is one method for determining the melting temperature in JIS K 7121-1987 "Testing Methods for Transition Temperatures of Plastics".

[2] Amorphous Resin (Preferably, Amorphous Polyester Resin b1) Contained in Continuous Phase From the viewpoint of controlling the storage modulus $G'_{50T}$ at 50° C. of the toner to be within the aforementioned range, the storage modulus $G'_{50b1}$ at 50° C. of the amorphous resin (preferably, the amorphous polyester resin b1) contained in the continuous phase in dynamic viscoelasticity measurement is preferably $1\times10^7$ Pa or more and $2\times10^9$ Pa or less and more preferably $1\times10^8$ Pa or more and $1\times10^9$ Pa or less.

From the viewpoint of controlling the storage modulus $G'_{100T}$ at 100° C. of the toner to be within the aforementioned range, the storage modulus $G'_{100b1}$ at 100° C. of the amorphous resin (preferably, the amorphous polyester resin b1) contained in the continuous phase in dynamic viscoelasticity measurement is preferably $1\times10^3$ Pa or more and $1\times10^6$ Pa or less and more preferably $2\times10^3$ Pa or more and $2\times10^5$ Pa or less.

From the viewpoint of controlling tan $\delta_T$ of the toner in the entire temperature range of 50° C. or more and 100° C. or less to be within the aforementioned range, tan $\delta_{b1}$ of the amorphous resin (preferably, the amorphous polyester resin b1) contained in the continuous phase in the entire temperature range of 50° C. or more and 100° C. or less in dynamic viscoelasticity measurement is preferably 0.001 or more and 4.0 or less and more preferably 0.001 or more and 2.0 or less.

[3] Amorphous Resin (Preferably, Amorphous Polyester Resin b2) Contained Core

From the viewpoint of controlling the storage modulus $G'_{50T}$ at 50° C. of the toner to be within the aforementioned range, the storage modulus $G'_{50b2}$ at 50° C. of the amorphous resin (preferably, the amorphous polyester resin b2) contained in the core in dynamic viscoelasticity measurement is preferably $1\times10^4$ Pa or more and $1\times10^7$ Pa or less and more preferably $3\times10^4$ Pa or more and $3\times10^5$ Pa or less.

From the viewpoint of controlling the storage modulus $G'_{100T}$ at 100° C. of the toner to be within the aforementioned range, the storage modulus $G'_{100b2}$ at 100° C. of the amorphous resin (preferably the amorphous polyester resin b2) contained in the core in dynamic viscoelasticity measurement is preferably $1\times10^3$ Pa or more and $3\times10^5$ Pa or less and more preferably $1\times10^4$ Pa or more and $2\times10^5$ Pa or less.

From the viewpoint of controlling tan $\delta_T$ of the toner in the entire temperature range of 50° C. or more and 100° C. or less to be within the aforementioned range, tan $\delta_{b2}$ of the amorphous resin (preferably, the amorphous polyester resin b2) contained in the core in the entire temperature range of 50° C. or more and 100° C. or less in dynamic viscoelasticity measurement is preferably less than 1 and more preferably 0.1 or more and 0.6 or less.

From the viewpoint of controlling tan $\delta_T$ of the toner to be within the aforementioned range in the entire temperature range of 50° C. or more and 100° C. or less, the storage modulus $G'_{50\text{-}100b2}$ of the amorphous resin (preferably, the amorphous polyester resin b2) contained in the core in the entire temperature range of 50° C. or more and 100° C. or less in dynamic viscoelasticity measurement is preferably $1\times10^3$ Pa or more and $1\times10^7$ Pa or less and more preferably $1\times10^4$ Pa or more and $3\times10^5$ Pa or less.

[4] Materials Contained in Toner Other than Amorphous Resin (Preferably Amorphous Polyester Resin b2) Contained in Core From the viewpoint of controlling the storage modulus $G'_{50T}$ at 50° C. of the toner to be within the aforementioned range, the storage modulus $G'_{50r}$ at 50° C. of the materials contained in the toner other than the amorphous resin (preferably, the amorphous polyester resin b2) in the core in dynamic viscoelasticity measurement is preferably $3\times10^6$ Pa or more and $9\times10^8$ Pa or less, more preferably $4\times10^6$ Pa or more and $7\times10^8$ Pa or less, and yet more preferably 1×108 Pa or more and $5\times10^8$ Pa or less.

From the viewpoint of controlling the storage modulus $G'_{100T}$ at 100° C. of the toner to be within the aforementioned range, the storage modulus $G'_{100r}$ at 100° C. of the materials contained in the toner other than the amorphous resin (preferably the amorphous polyester resin b2) in the core in dynamic viscoelasticity measurement is preferably $1\times10^3$ Pa or more and $1\times10^5$ Pa or less and more preferably $1\times10^3$ Pa or more and $3\times10^4$ Pa or less.

The aforementioned physical properties of the crystalline resin (preferably, the crystalline polyester resin a) contained in the continuous phase, the amorphous resin (preferably, the amorphous polyester resin b1) contained in the continuous phase, the amorphous resin (preferably, the amorphous polyester resin b2) contained in the core, and the materials contained in the toner other than the amorphous resin (preferably the amorphous polyester resin b2) contained in the core may each be determined by using a resin as a raw material before the toner is produced, or by using a resin isolated from the toner.

The storage modulus G' at 50° C., the storage modulus G' at 100° C., the storage modulus G' in the entire temperature range of 50° C. or more and 100° C. or less, and tan δ in the entire temperature range of 50° C. or more and 100° C. or less of each resin are measured in accordance with the description of "Dynamic viscoelasticity measurement of toner" above.

A method for isolating each of the resins (preferably the crystalline polyester resin a, the amorphous polyester resin b1, and the amorphous polyester resin b2) contained in the continuous phase, the core, and the coating layer in the toner will now be described.

Method for isolating crystalline polyester resin a (1) First, 0.25 g of toner is weighed, 40 mL of tetrahydrofuran (THF) is added thereto, and the resulting mixture is mixed and stirred for 3 hours.

(2) The liquid mixture obtained in (1) is separated in a centrifugal separator at 2000 rpm for 30 minutes.

(3) Precipitates after centrifugal separation obtained in (2) are taken out and washed with methanol to remove THF.

(4) The washed precipitates are placed in an aluminum dish or the like, and the methanol components are evaporated and dried in a vacuum dryer at a temperature adjusted to 50° C.

(5) To the obtained dry substance, 40 mL of THF is added, and the resulting mixture is mixed and stirred for 1 hour while being heated to 85° C.

(6) The liquid mixture obtained in (5) is filtered without cooling, and the supernatant is obtained. The supernatant is placed in an aluminum dish or the like, and the THF components are evaporated and dried in a vacuum dryer at a temperature adjusted to 50° C. As a result, a crystalline polyester resin a isolated from the toner is obtained.

Method for isolating amorphous polyester resin b1

(1) First, 0.25 g of toner is weighed, 40 mL of tetrahydrofuran (THF) is added thereto, and the resulting mixture is mixed and stirred for 3 hours.

(2) The liquid mixture obtained in (1) is separated in a centrifugal separator at 2000 rpm for 30 minutes.

(3) The supernatant after centrifugal separation obtained in (2) is placed in an aluminum dish or the like, and the methanol components are evaporated and dried in a vacuum dryer at a temperature adjusted to 50° C. As a result, an amorphous polyester resin b1 isolated from the toner is obtained.

Method for isolating amorphous polyester resin b2

(1) First, 0.25 g of toner is weighed, 40 mL of tetrahydrofuran (THF) is added thereto, and the resulting mixture is mixed and stirred for 3 hours.

(2) The liquid mixture obtained in (1) is separated in a centrifugal separator at 2000 rpm for 30 minutes.

(3) Precipitates after centrifugal separation obtained in (2) are taken out and washed with methanol to remove THF.

(4) The washed precipitates are placed in an aluminum dish or the like, and the methanol components are evaporated and dried in a vacuum dryer at a temperature adjusted to 50° C.

(5) To the obtained dry substance, 40 mL of THF is added, and the resulting mixture is mixed and stirred for 1 hour while being heated to 85° C.

(6) The liquid mixture obtained in (5) is filtered without cooling, and the THF insoluble fraction is obtained. The THF insoluble fraction is placed in an aluminum dish or the like, and the THF components are evaporated and dried in a vacuum dryer at a temperature adjusted to 50° C. As a result, an amorphous polyester resin b2 isolated from the toner is obtained.

Particle Diameter (Average Equivalent Circle Diameter) of Discontinuous Phase

From the viewpoint of controlling the storage modulus $G'_{100T}$ and tan $\delta_T$ of the toner to be within the aforementioned ranges, the average equivalent circle diameter (L1) of the discontinuous phase is preferably 100 nm or more and 300 nm or less, more preferably 150 nm or more and 250 nm or less, and yet more preferably 180 nm or more and 220 nm or less.

Thickness (Average Thickness) of Coating Layer

From the viewpoint of controlling the storage modulus $G'_{100T}$ and tan $\delta_T$ of the toner to be within the aforementioned ranges, the average thickness (L2) of the coating layer is preferably 20 nm or more and 50 nm or less, more preferably 30 nm or more and 45 nm or less, and yet more preferably 35 nm or more and 40 nm or less.

The method for measuring the average equivalent circle diameter of the discontinuous phase through cross-sectional observation of the toner will now be described.

First, toner particles are embedded by using a bisphenol A liquid epoxy resin and a curing agent, and then a sample for cutting is prepared. Next, the sample for cutting is cut at −100° C. with a cutter (for example, LEICA Ultramicrotome produced by Hitachi High-Technologies Corporation) by using a diamond knife so as to prepare a sample for observation. If the difference in luminance (contrast) described below is to be enhanced, the sample for observation may be left to stand in a desiccator in a ruthenium tetroxide atmosphere so as to be stained. A tape left in the desiccator is used to indicate the extent of staining.

The observation sample obtained as such is observed with a scanning transmission electron microscope (STEM). An image is recorded at a magnification at which one cross-section of one toner particle is within the field of view. The recorded image is analyzed with image analysis software (WinROOF produced by MITANI CORPORATION) under a condition of 0.010000 μm/pixel. This image analysis extracts the contour of the cross-section of the discontinuous phase on the basis of the difference in luminance (contrast) between the binder resin in the continuous phase (sea) in the toner particle and the binder resin in the discontinuous phase (islands) that has a core and a coating layer.

The projection area is then determined on the basis of the extracted contour of the cross-section of the discontinuous phase. Then the equivalent circle diameter of the discontinuous phase is determined from the projection area. The equivalent circle diameter is calculated from the formula: $2\times(\text{projection area}/\pi)^{1/2}$. One hundred toner particles are observed. For each toner particle, the discontinuous phase is selected and the equivalent circle diameter thereof is determined. The arithmetic mean value thereof is assumed to be the average equivalent circle diameter (L1) of the discontinuous phase.

Furthermore, on the basis of the difference in luminance (contrast) between the binder resin in the core and the binder resin in the coating layer, the contour of the cross-section of the core is extracted. The projection area of the core is determined on the basis of the contour of the cross-section of the core, and then the equivalent circle diameter of the core is determined. As with (L1) described above, one hundred toner particles are observed. For each toner particle, the core is selected and the equivalent circle diameter thereof is determined. The arithmetic mean value thereof is assumed to be the average equivalent circle diameter (L3) of the core. Then the difference between (L1) and (L3) is used to determine the average thickness (L2) of the coating layer from the formula: (L1−L3)/2).

(2) Toner Having a Structure Containing a Tetrahydrofuran (THF) Insoluble Fraction that Constitutes a Discontinuous Phase The toner having the structure (2) above has a continuous phase containing a binder resin (I) and a discontinuous phase being scattered in the continuous phase and containing a binder resin (II), and the binder resin (II) contains a THF insoluble fraction. In other words, a sea-island structure formed of the continuous phase corresponding to the sea and the discontinuous phase corresponding to islands (domains) is formed.

Binder Resins Contained in Continuous Phase and Discontinuous Phase

The binder resin (I) contained in the continuous phase and the binder resin (II) contained in the discontinuous phase are not particularly limited, but the binder resin (I) is preferably a resin that is substantially free of a THF insoluble fraction, and the binder resin (II) is preferably a resin that contains a THF insoluble fraction.

The phrase "substantially free of a THF insoluble fraction" means that the THF insoluble fraction content is 1.0 mass or less (more preferably, 0.5 mass % or less).

Except for the absence or presence of the THF insoluble fraction, the binder resin (I) and the binder resin (II) may be different resins (for example, resins that have different constitutional units in polymer chains (for example, resins synthesized by using, as starting materials, monomers having different molecular structures) or resins having the same constitutional units in the polymer chain but different average molecular weights) or may be the same resin.

Binder Resin (I) Contained in Continuous Phase

The continuous phase may contain, as a binder resin (I), a crystalline resin and an amorphous resin. Incorporation of a crystalline resin in the continuous phase tends to improve low-temperature fixability. From the viewpoint of improving the low-temperature fixability, the continuous phase more preferably contains a crystalline polyester resin and an amorphous polyester resin. (In the description below, a crystalline polyester resin contained in the continuous phase is referred to as a resin "A" and an amorphous polyester resin contained in the continuous phase is referred to as a resin "B1".)

The mass ratio of the crystalline resin to the amorphous resin in the continuous phase (more preferably, the mass ratio (A/B1) of the crystalline polyester resin A to the amorphous polyester resin B1) is preferably 0.04 or more and 1.0 or less, more preferably 0.09 or more and 0.6 or less, and yet more preferably 0.1 or more and 0.4 or less.

When the mass ratio of the crystalline resin to the amorphous resin (more preferably, the mass ratio (A/B1) of the crystalline polyester resin A to the amorphous polyester resin B1) is 0.04 or more, the low-temperature fixability tends to be improved. At a ratio of 1.0 or less, the fixing strength of the image tends to be increased.

The crystalline resin and the amorphous resin contained in the continuous phase may each be one resin or two or more resins. The crystalline polyester resin A and the amorphous polyester resin B1 contained in the continuous phase may each be one resin or two or more resins.

With respect to all binder resins contained in the continuous phase, the total content of the crystalline polyester resin A and the amorphous polyester resin B1 is preferably 50 mass % or more, more preferably 80 mass % or more, and yet more preferably 100 mass %.

Binder Resin (II) Contained in Discontinuous Phase

The discontinuous phase may contain, as a binder resin (II), an amorphous resin (more preferably, an amorphous polyester resin). This amorphous resin may contain a THF insoluble fraction.

(In the description below, an amorphous polyester resin contained in the discontinuous phase is referred to as a resin "B2".)

The tetrahydrofuran insoluble fraction content in the amorphous resin (more preferably, an amorphous polyester resin B2) contained in the discontinuous phase is preferably 90 mass % or more and 100 mass % or less, more preferably 92 mass % or more and 98 mass % or less, and yet more preferably 94 mass % or more and 96 mass % or less.

The tetrahydrofuran (THF) insoluble fraction refers to resin-derived solid components, in other words, a gel resin that forms a crosslinking structure. When the tetrahydrofuran insoluble fraction content is within the aforementioned range, it is easy to obtain a structure in which the discontinuous phase (domains) is scattered in the toner particles, and the storage modulus $G'_{50T}$ at 50° C., the storage modulus $G'_{100T}$ at 100° C., and tan $\delta_T$ in the entire temperature range of 50° C. or more and 100° C. or less of the toner can be easily controlled to be within the aforementioned ranges.

A method for measuring the tetrahydrofuran (THF) insoluble fraction content will now be described.

The THF insoluble fraction content may be measured by using a resin serving as a raw material before the toner is produced or by using a resin isolated from the toner.

The isolation method is as described above.

The THF insoluble fraction content is measured by the following method.

(1) First, 0.25 g of a resin is weighed, 40 mL of tetrahydrofuran is added thereto, and the resulting mixture is mixed and stirred for 3 hours. (2) Next, the liquid mixture obtained in (1) is separated in a centrifugal separator at 2000 rpm for 30 minutes. (3) Then 5 mL of a supernatant after centrifugal separation obtained in (2) is weighed and placed in an aluminum dish. The THF component is evaporated and dried in a vacuum dryer at a temperature adjusted to 50° C. (4) The THF insoluble fraction content is calculated from the following formula on the basis of the difference between the mass of the aluminum dish before drying and that after drying.

THF insoluble fraction [%]={0.25−[(total mass of supernatant and aluminum dish)−(mass of aluminum dish after drying)×8}]/0.25×100

The amorphous resin (more preferably, the amorphous polyester resin B2) contained in the discontinuous phase may be one resin or two or more resins.

With respect to all binder resins contained in the discontinuous phase, the content of the amorphous polyester resin B2 is preferably 50 mass % or more, more preferably 80 mass % or more, and yet more preferably 100 mass %.

Methods for Controlling $G'_{50T}$, $G'_{100T}$, and Tan $\delta_T$

For the toner having the structure (2) above, examples of the methods for controlling the storage modulus $G'_{50T}$, the storage modulus $G'_{100T}$ and tan $\delta_T$ includes the following methods.

Examples of the method for controlling the storage modulus $G'_{50T}$ of the toner include methods that involve adjusting the content and the storage modulus G' at 50° C. of the crystalline resin (preferably the crystalline polyester resin A) contained in the continuous phase, adjusting the storage modulus G' at 50° C. of the amorphous resin (preferably the amorphous polyester resin B1) contained in the continuous phase, and adjusting the content and the storage modulus G' at 50° C. of the amorphous resin (preferably the amorphous polyester resin B2) contained in the discontinuous phase.

Examples of the method for controlling the storage modulus $G'_{100T}$ of the toner include methods that involve adjusting the content and the storage modulus G' at 100° C. of the crystalline resin (preferably the crystalline polyester resin A) contained in the continuous phase, adjusting the storage modulus G' at 100° C. of the amorphous resin (preferably the amorphous polyester resin B1) contained in the continuous phase, adjusting the content and the storage modulus G' at 100° C. of the amorphous resin (preferably the amorphous polyester resin B2) contained in the discontinuous phase, and adjusting the particle diameter (specifically, the average equivalent circle diameter) of the discontinuous phase.

Examples of the method for controlling tan $\delta_T$ of the toner include methods that involve adjusting the content of the crystalline resin (preferably the crystalline polyester resin A) contained in the continuous phase and the storage modulus G' and the loss modulus G" thereof in the entire temperature range of 50° C. or more and 100° C., adjusting the storage modulus G' and the loss modulus G" of the amorphous resin (preferably the amorphous polyester resin B1) contained in the continuous phase in the entire temperature range of 50° C. or more and 100° C. or less, adjusting the content of the amorphous resin (preferably, the amorphous polyester resin B2) contained in the discontinuous phase and the storage modulus G' and the loss modulus G" thereof in the entire temperature range of 50° C. or more and 100° C. or less, and adjusting the particle diameter (specifically, the average equivalent circle diameter) of the discontinuous phase.

In particular, the storage modulus $G'_{50T}$, the storage modulus $G'_{100T}$ and tan δT of the toner can be easily controlled to be within the aforementioned ranges when the storage modulus G' and the loss modulus G" of the crystalline resin (preferably, the crystalline polyester resin A) contained in the continuous phase in the entire temperature range of 50° C. or more and 100° C. or less is adjusted to be different from the storage modulus G' and the loss modulus G" of the amorphous resin (preferably, the amorphous polyester resin B1) contained in the continuous phase in the entire temperature range of 50° C. or more and 100° C. or less.

G' and Tan δ of Resins

In the toner that has the structure (2) above, ranges of the storage modulus G' and the loss tangent tan δ of each of the resins contained in the continuous phase and the discontinuous phase may be as follows.

[1] Crystalline Resin (Preferably, Crystalline Polyester Resin A) Contained in Continuous Phase From the viewpoint of controlling the storage modulus $G'_{50T}$ at 50° C. of the toner to be within the aforementioned range, the storage modulus $G'_{50a}$ at 50° C. of the crystalline resin (preferably the crystalline polyester resin A) contained in the continuous phase in dynamic viscoelasticity measurement is preferably $1\times10^6$ Pa or more and $1\times10^9$ Pa or less and more preferably $1\times10^7$ Pa or more and $1\times10^8$ Pa or less.

From the viewpoint of controlling the storage modulus $G'_{100T}$ at 100° C. of the toner to be within the aforementioned range, the storage modulus $G'_{100A}$ at 100° C. of the crystalline resin (preferably the crystalline polyester resin A) contained in the continuous phase in dynamic viscoelasticity measurement is preferably $1\times10^{-1}$ Pa or more and $1\times10^2$ Pa or less and more preferably $1\times10^0$ Pa or more and $1\times10^1$ Pa or less.

From the viewpoint of controlling tan $\delta_T$ of the toner in the entire temperature range of 50° C. or more and 100° C. or less to be within the aforementioned range, tan $\delta_A$ of the crystalline resin contained in the continuous phase (preferably the crystalline polyester resin A) in the entire temperature range of 50° C. or more and the melting temperature of the crystalline resin or less in dynamic viscoelasticity measurement is preferably 0.01 or more and 1.0 or less and more preferably 0.05 or more and 0.5 or less.

The melting temperature of the crystalline resin is preferably 50° C. or more and 100° C. or less, more preferably 55° C. or more and 90° C. or less, and yet more preferably 60° C. or more and 85° C. or less.

The melting temperature is determined from a DSC curve obtained by differential scanning calorimetry (DSC) by the method described in "Melting peak temperature", which is one method for determining the melting temperature in JIS K 7121-1987 "Testing Methods for Transition Temperatures of Plastics".

[2] Amorphous Resin Contained in Continuous Phase (Preferably Amorphous Polyester Resin B1)

From the viewpoint of controlling the storage modulus $G'_{50T}$ at 50° C. of the toner to be within the aforementioned range, the storage modulus $G'_{50B1}$ at 50° C. of the amorphous resin (preferably the amorphous polyester resin B1) contained in the continuous phase in dynamic viscoelasticity measurement is preferably $1\times10^7$ Pa or more and $2\times10^9$ Pa or less and more preferably $1\times10^8$ Pa or more and $1\times10^9$ Pa or less.

From the viewpoint of controlling the storage modulus $G'_{100T}$ at 100° C. of the toner to be within the aforementioned range, the storage modulus $G'_{100B1}$ at 100° C. of the amorphous resin (preferably the amorphous polyester resin B1) contained in the continuous phase in dynamic viscoelasticity measurement is preferably $1\times10^3$ Pa or more and $1\times10^6$ Pa or less and more preferably $2\times10^3$ Pa or more and $2\times10^5$ Pa or less.

From the viewpoint of controlling tan $\delta_T$ of the toner in the entire temperature range of 50° C. or more and 100° C. or less to be within the aforementioned range, tan $\delta_{B1}$ of the amorphous resin contained in the continuous phase (preferably the amorphous polyester resin B1) in the entire temperature range of 50° C. or more and 100° C. or less in dynamic viscoelasticity measurement is preferably 0.001 or more and 4.0 or less and more preferably 0.001 or more and 2.0 or less.

[3] Amorphous Resin (Preferably, Amorphous Polyester Resin B2) Contained in Discontinuous Phase From the viewpoint of controlling the storage modulus $G'_{50T}$ at 50° C. of the toner to be within the aforementioned range, the storage modulus $G'_{50B2}$ at 50° C. of the amorphous resin (preferably the amorphous polyester resin B2) contained in the discontinuous phase in dynamic viscoelasticity measurement is preferably $1\times10^4$ Pa or more and $1\times10^7$ Pa or less and more preferably $1\times10^4$ Pa or more and $1\times10^6$ Pa or less.

From the viewpoint of controlling the storage modulus $G'_{100T}$ at 100° C. of the toner to be within the aforementioned range, the storage modulus $G'_{100B2}$ at 100° C. of the amorphous resin (preferably the amorphous polyester resin B2) contained in the discontinuous phase in dynamic viscoelasticity measurement is preferably $1\times10^4$ Pa or more and $1\times10^7$ Pa or less and more preferably $1\times10^4$ Pa or more and $1\times10^6$ Pa or less.

From the viewpoint of controlling tan $\delta_T$ of the toner in the entire temperature range of 50° C. or more and 100° C. or less to be within the aforementioned range, tan $\delta_{B2}$ of the amorphous resin (preferably, the amorphous polyester resin B2) contained in the discontinuous phase in the entire temperature range of 50° C. or more and 100° C. or less in dynamic viscoelasticity measurement is preferably less than 1 and more preferably 0.1 or more and 0.6 or less.

From the viewpoint of controlling tan $\delta_T$ of the toner to be within the aforementioned range in the entire temperature range of 50° C. or more and 100° C. or less, the storage modulus $G'_{50\text{-}100b}2$ of the amorphous resin (preferably the amorphous polyester resin B2) contained in the discontinuous phase in the entire temperature range of 50° C. or more and 100° C. or less in dynamic viscoelasticity measurement is preferably $1\times10^3$ Pa or more and $1\times10^7$ Pa or less, more preferably $1\times10^4$ Pa or more and $1\times10^7$ Pa or less, and yet more preferably $1\times10^4$ Pa or more and $1\times10^6$ Pa or less.

[4] Materials Contained in Toner Other than Amorphous Resin (Preferably Amorphous Polyester Resin B2) Contained in Discontinuous Phase From the viewpoint of controlling the storage modulus $G'_{50T}$ at 50° C. of the toner to be within the aforementioned range, the storage modulus $G'_{50R}$ at 50° C. of the materials contained in the toner other than the amorphous resin (preferably the amorphous polyester resin B2) contained in the discontinuous phase in dynamic viscoelasticity measurement is preferably 3×106 Pa or more and $9\times10^8$ Pa or less and more preferably $4\times10^6$ Pa or more and $7\times10^8$ Pa or less.

From the viewpoint of controlling the storage modulus $G'_{100T}$ at 100° C. of the toner to be within the aforementioned range, the storage modulus $G'_{100R}$ at 100° C. of the materials contained in the toner other than the amorphous resin (preferably the amorphous polyester resin B2) contained in the discontinuous phase in dynamic viscoelasticity measurement is preferably $1\times10^3$ Pa or more and $1\times10^5$ Pa or less and more preferably $1\times10^3$ Pa or more and $3\times10^4$ Pa or less.

The aforementioned physical properties of the crystalline resin (preferably, the crystalline polyester resin A) contained in the continuous phase, the amorphous resin (preferably, the amorphous polyester resin B1) contained in the continuous phase, the amorphous resin (preferably, the amorphous polyester resin B2) contained in the discontinuous phase, and the materials contained in the toner other than the amorphous resin (preferably the amorphous polyester resin B2) contained in the discontinuous phase may each be determined by using a resin as a raw material before the toner is produced, or by using a resin isolated from the toner.

The isolation method is as described above.

The storage modulus G' at 50° C., the storage modulus G' at 100° C., the storage modulus G' in the entire temperature range of 50° C. or more and 100° C. or less, and tan δ in the entire temperature range of 50° C. or more and 100° C. or less of each resin are measured in accordance with the description in "Dynamic viscoelasticity measurement of the toner" above.

Particle Diameter (Average Equivalent Circle Diameter) of Discontinuous Phase

From the viewpoint of controlling the storage modulus $G'_{100T}$ and tan $\delta_T$ of the toner to be within the aforementioned ranges, the average equivalent circle diameter (L2) of the discontinuous phase is preferably 100 nm or more and 300 nm or less, more preferably 150 nm or more and 250 nm or less, and yet more preferably 180 nm or more and 220 nm or less.

The average equivalent circle diameter (L2) is measured in accordance with the method for measuring the average equivalent circle diameter (L1) described above.

Components constituting the toner of the exemplary embodiment and other features will now be described in detail.

The toner of the exemplary embodiment contains toner particles and, if needed, an external additive.

Toner Particles

The toner particles are formed of, for example, a binder resin and, if needed, a coloring agent, a releasing agent, and other additives.

Binder Resin

Examples of the binder resin include vinyl resins composed of homopolymers of monomers and copolymers obtained by combining two or more monomers. Examples of the monomers include styrenes (for example, styrene, parachlorostyrene, and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene).

Examples of the binder resin also include non-vinyl resins such as epoxy resins, polyester resins, polyurethane resins, polyamide resins, cellulose resins, polyether resins, and modified rosin, mixtures of the vinyl resins and the non-vinyl resins described above, and graft polymers obtained by polymerizing vinyl monomers in the co-presence of these.

These binder resins may be used alone or in combination.

When the toner particles of this exemplary embodiment are toner particles in the toner having the aforementioned structure (1), the continuous phase may contain a crystalline polyester resin a and an amorphous polyester resin b1, the core may contain an amorphous polyester resin b2, and the coating layer may contain a vinyl resin. However, this feature is not limiting.

When the toner particles of this exemplary embodiment are toner particles in the toner having the aforementioned structure (2), the continuous phase may contain a crystalline polyester resin A and an amorphous polyester resin B1, and the discontinuous phase may contain an amorphous polyester resin B2 containing a THF insoluble fraction.

Examples of the polyester resin include known amorphous polyester resins. An amorphous polyester resin and a crystalline polyester resin may be used in combination as the polyester resin. However, the amount of the crystalline polyester resin relative to all binder resins in the toner may be in the range of 2 mass % or more and 40 mass % or less (preferably 2 mass % or more and 20 mass % or less).

Note that the "crystallinity" of a resin refers to having a clear endothermic peak instead of stepwise changes in amount of endothermic energy in differential scanning calorimetry (DSC). Specifically, "crystallinity" refers to the instance where the half width of the endothermic peak measured at a temperature elevation rate of 10 (° C./min) is within 10° C.

Meanwhile, the "amorphousness" of a resin refers to the instance where the half width exceeds 10° C., the instance where stepwise changes in amount of endothermic energy are exhibited, or the instance where a clear endothermic peak is not detected.

Amorphous Polyester Resin

Examples of the amorphous polyester resin include condensation polymers of polycarboxylic acids and polyhydric alcohols. A commercially available amorphous polyester resin may be used, or an amorphous polyester resin prepared by synthesis may be used.

Examples of the polycarboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalene dicarboxylic acid), anhydrides thereof, and lower (for example, having 1 to 5 carbon atoms) alkyl esters thereof. Among these, aromatic dicarboxylic acids may be used as the polycarboxylic acid.

For the polycarboxylic acids, a trivalent or higher carboxylic acid that has a crosslinked structure or a branched structure may be used in combination with a dicarboxylic acid. Examples of the trivalent or higher carboxylic acids include trimellitic acid, pyromellitic acid, anhydrides thereof, and lower (for example, having 1 to 5 carbon atoms) alkyl esters thereof.

The polycarboxylic acids may be used alone or in combination.

Examples of the polyhydric alcohol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, an ethylene oxide adduct of bisphenol A and a propylene oxide adduct of bisphenol A). Of these, the polyhydric alcohol is, for example, preferably an aromatic diol or an alicyclic diol, and more preferably is an aromatic diol.

For the polyhydric alcohol, a trihydric or higher alcohol that has a crosslinked structure or a branched structure may be used in combination with a diol. Examples of the trihydric or higher alcohols include glycerin, trimethylolpropane, and pentaerythritol.

The polyhydric alcohols may be used alone or in combination.

The glass transition temperature (Tg) of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass transition onset temperature" described in the method for determining the glass transition temperature in JIS K 7121-1987 "Testing Methods for Transition Temperatures of Plastics".

The weight average molecular weight (Mw) of the amorphous polyester resin is preferably 5,000 or more and 1,000,000 or less and more preferably 7,000 or more and 500,000 or less.

The number average molecular weight (Mn) of the amorphous polyester resin may be 2,000 or more and 100,000 or less.

The molecular weight distribution Mw/Mn of the amorphous polyester resin is preferably 1.5 or more and 100 or less and more preferably 2 or more and 60 or less.

The weight average molecular weight and the number average molecular weight are measured by gel permeation chromatography (GPC). The molecular weight measurement by GPC is conducted by using GPC•HLC-8120GPC produced by TOSOH CORPORATION as a measuring instrument with columns, TSKgel Super HM-M (15 cm) produced by TOSOH CORPORATION, and a THF solvent. The weight average molecular weight and the number average molecular weight are calculated from the measurement results by using the molecular weight calibration curves obtained from monodisperse polystyrene standard samples.

The amorphous polyester resin is obtained by a known production method. Specifically, for example, the polyester resin is obtained by setting the polymerization temperature to 180° C. or more and 230° C. or less, decreasing the pressure in the reaction system as necessary, and performing a reaction while removing water and alcohol generated during condensation.

When the monomers used as the raw materials do not dissolve or are not compatible with each other at a reaction temperature, a solvent having a high boiling point may be added as a dissolving aid to dissolve the monomers. In this case, the polycondensation reaction is performed while distilling away the dissolving aid. When monomers poorly compatible with each other are present, the poorly compatible monomer and an acid or alcohol to be subjected to polycondensation with that monomer may be preliminarily condensed, and then the resulting product may be subjected to polycondensation with other components.

Crystalline Polyester Resin

Examples of the crystalline polyester resin include polycondensates of polycarboxylic acids and polyhydric alcohols. A commercially available crystalline polyester resin may be used, or a crystalline polyester resin prepared by synthesis may be used.

Here, in order to simplify formation of the crystal structure, the crystalline polyester resin may be a polycondensate prepared by using a polymerizable monomer having a linear aliphatic group rather than a polymerizable monomer having an aromatic group.

Examples of the polycarboxylic acid include aliphatic dicarboxylic acids (for example, oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (for example, dibasic acids such as phthalic acid, isophthalic acid, terephthalic acid, and naphthalene-2,6-dicarboxylic acid), anhydrides thereof, and lower (for example, having 1 to 5 carbon atoms) alkyl esters thereof.

For the polycarboxylic acids, a trivalent or higher carboxylic acid that has a crosslinked structure or a branched structure may be used in combination with a dicarboxylic acid. Examples of the tricarboxylic acids include aromatic carboxylic acids (for example, 1,2,3-benzenetricarboxylic acid, 1,2,4-benzenetricarboxylic acid, and 1,2,4-naphthalenetricarboxylic acid), anhydrides thereof, and lower (for example, having 1 to 5 carbon atoms) alkyl esters thereof.

For the polycarboxylic acids, these dicarboxylic acids may be used in combination with dicarboxylic acids having a sulfonic acid group or an ethylenic double bond.

The polycarboxylic acids may be used alone or in combination.

Examples of the polyhydric alcohol include aliphatic diols (for example, linear aliphatic diols having a main chain containing 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-icosanedecanediol. Among these, 1,8-octanediol, 1,9-nonanediol, and 1,10-decanediol are preferable as the aliphatic diol.

For the polyhydric alcohol, a trihydric or higher alcohol that has a crosslinked structure or a branched structure may be used in combination with a diol. Examples of the trihydric or higher alcohols include glycerin, trimethylolethane, trimethylolpropane, and pentaerythritol.

The polyhydric alcohols may be used alone or in combination.

Here, the polyhydric alcohol preferably has an aliphatic diol content of 80 mol % or more and more preferably 90 mol % or more.

The melting temperature of the crystalline polyester resin is preferably 50° C. or more and 100° C. or less, more preferably 55° C. or more and 90° C. or less, and yet more preferably 60° C. or more and 85° C. or less.

The melting temperature is determined from the DSC curve obtained by differential scanning calorimetry (DSC) by the method described in "Melting peak temperature", which is one method for determining the melting temperature in JIS K 7121-1987 "Testing Methods for Transition Temperatures of Plastics".

The weight average molecular weight (Mw) of the crystalline polyester resin may be 6,000 or more and 35,000 or less.

The crystalline polyester resin is, for example, obtained by a known production method as with the amorphous polyester resin.

Vinyl Resin

A vinyl resin is a polymer obtained by polymerizing at least a vinyl monomer (in other words, a vinyl group ($CH_2{=}C(-R^{B1})-$/ where $R^{B1}$ represents a hydrogen atom or a methyl group)).

In this description, the notation "(meth)acryl" covers both "acryl" and "methacryl".

Examples of the vinyl monomer include (meth)acrylic acid and (meth)acrylic acid esters. Examples of the (meth) acrylic acid esters include (meth)acrylic acid alkyl esters (for example, methyl (meth)acrylate, ethyl (meth)acrylate, n-propyl (meth)acrylate, n-butyl (meth)acrylate, n-pentyl (meth)acrylate, n-hexyl (meth)acrylate, n-heptyl (meth) acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, cyclohexyl (meth)acrylate, and t-butylcyclohexyl (meth)acrylate), (meth)acrylic acid aryl esters (for example, phenyl (meth)

acrylate, biphenyl (meth)acrylate, diphenylethyl (meth) acrylate, t-butylphenyl (meth)acrylate, and terphenyl (meth) acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, (meth)acrylamide, styrene, alkyl-substituted styrene (for example, α-methylstyrene, 2-methylstyrene, 3-methylstyrene, 4-methylstyrene, 2-ethylstyrene, 3-ethylstyrene, and 4-ethylstyrene), halogen-substituted polystyrene (for example, 2-chlorostyrene, 3-chlorostyrene, and 4-chlorostyrene), and vinylnaphthalene.

Difunctional or higher vinyl monomers (for example, multifunctional vinyl monomers having two or more vinyl groups) may also be used.

Examples of the difunctional vinyl monomers include divinylbenzene, divinylnaphthalene, di(meth)acrylate compounds (for example, diethylene glycol di(meth)acrylate, methylenebis(meth)acrylamide, decanediol diacrylate, and glycidyl (meth)acrylate), polyester di(meth)acrylate, and 2-([1'-methylpropylideneamino]carboxyamino)ethyl methacrylate.

Examples of trifunctional or higher vinyl monomers include tri(meth)acrylate compounds (for example, pentaerythritol tri(meth)acrylate, trimethylolethane tri(meth) acrylate, and trimethylolpropane tri(meth)acrylate), tetra(meth)acrylate compounds (for example, pentaerythritol tetra (meth)acrylate and oligoester (meth)acrylate), 2,2-bis(4-methacryloxy, polyethoxyphenyl)propane, diallyl phthalate, triallyl cyanurate, triallyl isocyanurate, triallyl trimellitate, and diallyl chlorendate.

From the viewpoint of fixability, the vinyl monomer may be a (meth)acrylic acid ester having an alkyl group having 2 or more and 14 or less carbon atoms (more preferably, 2 or more and 10 or less carbon atoms and yet more preferably 3 or more and 8 or less carbon atoms).

The vinyl monomers may be used alone or in combination.

When a vinyl monomer is contained in the coating layer, the glass transition temperature Tg thereof may be lower than the fixing temperature (in other words, the set temperature during fixing in the image forming apparatus).

The amount of the binder resin relative to the entire toner particles is, for example, preferably 40 mass % or more and 95 mass % or less, is more preferably 50 mass % or more and 90 mass % or less, and is yet more preferably 60 mass % or more and 85 mass % or less.

Coloring Agent

Examples of the coloring agent include pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

A white pigment may be contained as a coloring agent. Examples of the white pigment include titanium oxide (for example, anatase titanium oxide particles and rutile titanium oxide particles), barium sulfate, zinc oxide, and calcium carbonate. Among these, titanium oxide is preferable as the white pigment.

A brilliant pigment may be contained as a coloring agent. Examples of the brilliant pigment include metal powder such as pearl pigment powder, aluminum powder, and stainless steel powder; metal flakes; glass beads; glass flakes; mica; and micaceous iron oxide (MIO).

These coloring agents may be used alone or in combination.

The coloring agent may be a surface-treated coloring agent or may be used in combination with a dispersant, if needed. Two or more coloring agents may be used in combination.

The amount of the coloring agent relative to the entire toner particles is, for example, preferably 1 mass % or more and 30 mass % or less and is more preferably 3 mass % or more and 15 mass % or less.

Releasing Agent

Examples of the releasing agent include hydrocarbon wax; natural wax such as carnauba wax, rice wax, and candelilla wax; synthetic or mineral or petroleum wax such as montan wax; and ester wax such as fatty acid esters and montanic acid esters. The releasing agent is not limited to these.

The melting temperature of the releasing agent is preferably 50° C. or higher and 110° C. or lower and is more preferably 60° C. or higher and 100° C. or lower.

The melting temperature is determined from the DSC curve obtained by differential scanning calorimetry (DSC) by the method described in "Melting peak temperature", which is one method for determining the melting temperature in JIS K 7121-1987 "Testing Methods for Transition Temperatures of Plastics".

The releasing agent content relative to, for example, the entire toner particles is preferably 1 mass % or more and 20 mass % or less and is more preferably 5 mass % or more and 15 mass % or less.

Other Additives

Examples of other additives include known additives such as magnetic materials, charge controllers, and inorganic powder. These additives are internal additives and contained inside the toner particles.

Properties, Etc., of Toner Particles

The toner particles may be a single-layer-structure toner particles, or core-shell-structure toner particles each constituted by a core (core particle) and a coating layer (shell layer) coating the core.

Core-shell toner particles may include a core containing a binder resin and, optionally, other additives such as a coloring agent and a releasing agent, and a coating layer that contains a binder resin, for example.

The volume-average particle diameter (D50v) of the toner particles is preferably 2 μm or more and 10 μm or less and more preferably 4 μm or more and 8 μm or less.

Various average particle diameters and particle size distribution indices of the toner particles are measured by using a Coulter Multisizer II (produced by Beckman Coulter Inc.) with ISOTON-II (produced by Beckman Coulter Inc.) as the electrolyte.

In measurement, 0.5 mg or more and 50 mg of a measurement sample is added to 2 ml of a 5 mass aqueous solution of a surfactant (may be sodium alkyl benzenesulfonate) serving as the dispersant. The resulting mixture is added to 100 ml or more and 150 ml or less of the electrolyte.

The electrolyte in which the sample is suspended is dispersed for 1 minute in an ultrasonic disperser, and the particle size distribution of the particles having a diameter in the range of 2 μm or more and 60 μm or less is measured by using Coulter Multisizer II with apertures having an aperture diameter of 100 μm. The number of the particles sampled is 50,000.

With respect to the particle size ranges (channels) divided on the basis of the measured particle size distribution, cumulative distributions of the volume and the number are plotted from the small diameter side. The particle diameters at 16% accumulation are defined as a volume particle diameter D16v and a number particle diameter D16p, the particle diameter at 50% accumulation are defined to be a volume-average particle diameter D50v and cumulative number-average particle diameter D50p, and the particle diameters at 84% accumulation are defined as a volume particle diameter D84v and a number particle diameter D84p.

The volume particle size distribution index (GSDv) is calculated as $(D84v/D16v)^{1/2}$, and the number particle size distribution index (GSDp) is calculated as $(D84p/D16p)^{1/2}$ by using these values.

The average circularity of the toner particles is preferably 0.94 or more and 1.00 or less, and more preferably 0.95 or more and 0.98 or less.

The average circularity of the toner particles is determined by (circle-equivalent perimeter)/(perimeter) [(perimeter of the circle having the same projection area as the particle image)/(perimeter of particle projection image)]. Specifically, it is the value measured by the following method.

First, toner particles to be measured are sampled by suction so as to form a flat flow, and particle images are captured as a still image by performing instantaneous strobe light emission. The particle image is analyzed by a flow particle image analyzer (FPIA-3000 produced by Sysmex Corporation) to determine the average circularity. The number of particles sampled in determining the average circularity is 3500.

When the toner contains an external additive, the toner (developer) to be measured is dispersed in surfactant-containing water, and then ultrasonically processed to obtain toner particles from which the external additive has been removed.

External Additive

An example of the external additive is inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $Cao.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles serving as an external additive may be hydrophobized. Hydrophobizing involves, for example, immersing inorganic particles in a hydrophobizing agent. The hydrophobizing agent may be any, and examples thereof include silane coupling agents, silicone oils, titanate coupling agents, and aluminum coupling agents. These may be used alone or in combination.

The amount of the hydrophobizing agent is typically 1 part by mass or more and 10 parts by mass or less relative to 100 parts by mass of the inorganic particles.

Examples of the external additive include resin particles (resin particles of polystyrene, polymethyl methacrylate (PMMA), melamine resin, etc.), and cleaning activating agents (for example, particles metal salts of higher aliphatic acids such as zinc stearate and fluorine-based high-molecular-weight materials).

The externally added amount of the external additive is, for example, preferably 0.01 mass % or more and 5 mass % or less and is more preferably 0.01 mass % or more and 2.0 mass % or less relative to the toner particles.

Method for Producing Toner

Next, a method for producing the toner of the exemplary embodiment is described.

The toner of this exemplary embodiment is obtained by preparing toner particles and then externally adding an external additive to the toner particles.

The toner particles may be produced by a dry method (for example, a kneading and pulverizing method) or a wet method (for example, an aggregation and coalescence method, a suspension polymerization method, or a dissolution suspension method). The toner particles may be made by any known process.

Among these methods, the aggregation and coalescence method may be employed to produce toner particles.

Specifically, for example, when the toner particles are to be produced by the aggregation and coalescence method, the toner particles are produced through, the following steps:

a step of preparing a resin particle dispersion containing dispersed resin particles that will serve as a binder resin (resin particle dispersion preparation step); a step of inducing the resin particles (if needed, other particles) to aggregate in the resin particle dispersion (if needed, a dispersion after mixing with other particle dispersion) so as to form aggregated particles (aggregated particle forming step); and a step of heating the aggregated particle dispersion containing dispersed aggregated particles so as to fuse and coalesce the aggregated particles to form toner particles (fusing and coalescence step).

These steps will now be described in detail.

In the description below, a method for obtaining toner particles that contain a coloring agent and a releasing agent is described; however, the coloring agent and the releasing agent are optional. Naturally, additives other than the coloring agent and the releasing agent may be used.

Resin Particle Dispersion Preparation Step

First, a resin particle dispersion containing dispersed resin particles that will function as a binder resin and, for example, a coloring agent particle dispersion containing dispersed coloring agent particles and a releasing agent particle dispersion containing dispersed releasing agent particles are prepared.

The resin particle dispersion is, for example, prepared by dispersing resin particles in a dispersion medium by using a surfactant.

Examples of the dispersion medium used in the resin particle dispersion include aqueous media.

Examples of the aqueous media include water such as distilled water and ion exchange water, and alcohols. These may be used alone or in combination.

Examples of the surfactant include anionic surfactants such as sulfate esters, sulfonates, phosphate esters, and soaps; cationic surfactants such as amine salts and quaternary ammonium salts; and nonionic surfactants such as polyethylene glycol, alkyl phenol-ethylene oxide adducts, and polyhydric alcohols. Among these, an anionic surfactant or a cationic surfactant may be used. A nonionic surfactant may be used in combination with an anionic surfactant or a cationic surfactant.

The surfactants may be used alone or in combination.

Examples of the method for dispersing the resin particles in a dispersion medium to obtain a resin particle dispersion include typical dispersion methods that use, for example, a rotational shear-type homogenizer and a ball mill, a sand mill, and a dyno mill that use media. Depending on the type of the resin particles, for example, resin particles may be dispersed in the resin particle dispersion by a phase-inversion emulsification method.

The phase-inversion emulsification method is a method that involves dissolving a resin to be dispersed in a hydrophobic organic solvent that can dissolve that resin, adding a base to the organic continuous phase (O phase) to neutralize, and injecting a water medium (W phase) so as to perform resin conversion (phase inversion) from W/O to O/W so as to form a discontinuous phase and disperse particles of the resin in the water medium.

The volume-average particle diameter of the resin particles dispersed in the resin particle dispersion is, for example, preferably 0.01 μm or more and 1 μm or less, more preferably 0.08 μm or more and 0.8 μm or less, and yet more preferably 0.1 μm or more and 0.6 μm or less.

The volume-average particle diameter of the resin particles is measured by obtaining a particle size distribution by measurement with a laser diffraction scattering particle size distribution meter (for example, LA-700 produced by Horiba Ltd.), drawing a cumulative distribution for volume from the small particle diameter side with respect to the divided particle size ranges (channels), and determining the particle diameter at 50% accumulation with respect to all particles as the volume-average particle diameter D50v. The volume-average particle diameter of other particles in the dispersion is also measured in the same manner.

The resin particle content in the resin particle dispersion is, for example, preferably 5 mass % or more and 50 mass or less and is more preferably 10 mass % or more and 40 mass % or less.

The coloring agent particle dispersion and the releasing agent particle dispersion are also prepared in the same manner as the resin particle dispersion, for example. The matters relating to the volume-average particle diameter, the dispersion medium, the dispersing method, and the particle content of the resin particle dispersion equally apply to the coloring agent particles dispersed in the coloring agent particle dispersion and the releasing agent particles dispersed in the releasing agent particle dispersion.

Note that when a toner having the structure (1) above is to be formed, in the resin particle dispersion preparation step, a composite resin particle dispersion in which a coating layer containing a binder resin (iii) (more preferably, a vinyl resin B) is disposed around a core containing a binder resin (ii) (more preferably, an amorphous polyester resin A2) may be prepared.

For example, a resin particle dispersion of an amorphous polyester resin A2 having unsaturated double bonds is prepared, and, a vinyl monomer and an initiator are added thereto to induce a reaction. In this manner, a composite resin particle dispersion having a core containing the amorphous polyester resin A2 and a coating layer covering the core and containing a vinyl resin B can be prepared.

In addition, a resin particle dispersion (more preferably, a resin particle dispersion containing an amorphous polyester resin A1 and a resin particle dispersion containing a crystalline polyester resin C) containing a binder resin (i) and being used for a continuous phase may be prepared separately from this composite resin particle dispersion.

When a toner having the structure (2) above is to be formed, a resin having a crosslinked structure may be formed as a binder resin (II) contained in the discontinuous phase. Specifically, in at least one of the resin particle dispersion preparation step and the aggregated particle forming step, a crosslinked structure (in other words, a gel structure) may be formed in the binder resin (II) by a known method that uses a polymerization initiator, a crosslinking agent, etc.

Aggregated Particle Forming Step

Next, the resin particle dispersion is mixed with the coloring agent particle dispersion and the releasing agent particle dispersion.

In the mixed dispersion, hetero-aggregation of the resin particles, coloring agent particles, and the releasing agent particles is induced so as to form aggregated particles containing the resin particles, the coloring agent particles, and the releasing agent particles and having a diameter close to the diameter of the toner particles.

When a toner having the structure (1) above is to be formed, a toner having a structure formed of a continuous phase and a discontinuous phase having a core and a coating layer may be obtained by using, as the resin particle dispersions, the aforementioned composite resin particle dispersion and a resin particle dispersion containing the binder resin (i) and being used for the continuous phase.

Specifically, for example, an aggregating agent is added to the mixed dispersion while the pH of the mixed dispersion is adjusted to acidic (for example, a pH of 2 or more and 5 or less), and after a dispersion stabilizer is added as needed, the dispersion is heated to a temperature close to the glass transition temperature of the resin particles (specifically, for example, a temperature 10° C. to 30° C. lower than the glass transition temperature of the resin particles) so as to aggregate the particles dispersed in the mixed dispersion and form aggregated particles.

In the aggregated particle forming step, for example, while the mixed dispersion is being stirred in a rotational shear-type homogenizer, the aggregating agent may be added to the mixed dispersion at room temperature (for example, 25° C.) and the pH of the mixed dispersion may be adjusted to acidic (for example, a pH of 2 or more and 5 or less), and then heating may be performed after the dispersion stabilizer is added as needed.

Examples of the aggregating agent include a surfactant having an opposite polarity to the surfactant used as the dispersant added to the mixed dispersion, an inorganic metal salt, and a divalent or higher valent metal complex. In particular, when a metal complex is used as the aggregating agent, the amount of the surfactant used is reduced, and the charge characteristics are improved.

An additive that forms a complex with a metal ion in the aggregating agent or that forms a similar bond therewith may be used as needed. An example of such an additive is a chelating agent.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water soluble chelating agent may be used as the chelating agent. Examples of the chelating agent include oxycarboxylic acids such as tartaric acid, citric acid, and gluconic acid, iminodiacid (IDA), nitrilotriacetic acid (NTA), and ethylenediaminetetraacetic acid (EDTA).

The amount of the chelating agent added is, for example, preferably 0.01 parts by mass or more and 5.0 parts by mass or less and more preferably 0.1 parts by mass or more and less than 3.0 parts by mass or less relative to 100 parts by mass of the resin particles.

Fusing and Coalescence Step

Next, the aggregated particle dispersion containing dispersed aggregated particles is heated to a temperature equal to or higher than the glass transition temperature of the resin particles (for example, a temperature 10° C. to 30° C. higher than the glass transition temperature of the resin particles) to fuse and coalesce the aggregated particles and form toner particles.

The toner particles are obtained through the above-described steps.

Note that, the toner particles may be produced by performing, after obtaining the aggregated particle dispersion containing dispersed aggregated particles, a step of forming second aggregated particles, the step involving mixing a resin particle dispersion containing dispersed resin particles with the aggregated particle dispersion so as to induce aggregation to attach the resin particles to the surfaces of the aggregated particles; and a step of heating a second aggregated particle dispersion containing the dispersed second aggregated particles so as to fuse and coalesce the second aggregated particles to form toner particles having a core/shell structure.

Here, after completion of the fusing and coalescence step, the toner particles formed in the solution are subjected to known washing step, solid-liquid separation step, and drying step so as to obtain toner particles in a dry state.

The washing step may involve thorough displacement washing with ion exchange water from the viewpoint of chargeability. The solid-liquid separation step is not particularly limited; however, from the viewpoint of productivity, suction filtration, pressure filtration or the like may be performed. The drying step is also not particularly limited; however, from the viewpoint of productivity, freeze-drying, flash-drying, fluid-drying, vibration-type fluid-drying, or the like may be performed.

The toner of this exemplary embodiment is produced by, for example, adding an external additive to the obtained toner particles in a dry state, and mixing the resulting mixture. Mixing may be performed by using a V blender, a Henschel mixer, a Loedige mixer, or the like. If needed, a vibrating screen, an air screen, or the like may be used to remove coarse particles of the toner.

Electrostatic Charge Image Developer

The electrostatic charge image developer of the exemplary embodiment contains at least the toner of the exemplary embodiment.

The electrostatic charge image developer of the exemplary embodiment may be a one-component developer that contains only the toner of the exemplary embodiment or a two-component developer that is a mixture of the toner and a carrier.

The carrier is not particularly limited and may be any known carrier. Examples of the carrier include a coated carrier prepared by covering the surface of a magnetic powder core with a coating resin, a magnetic powder-dispersed carrier prepared by dispersing and blending magnetic powder in a matrix resin, and a resin-impregnated carrier prepared by impregnating porous magnetic powder with a resin.

The magnetic powder-dispersed carrier and the resin-impregnated carrier may each be a carrier prepared by covering a core formed of the particle that constitutes that carrier with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylate copolymer, a straight silicone resin containing an organosiloxane bond and modified products thereof, fluororesin, polyester, polycarbonate, phenolic resin, and epoxy resin.

The coating resin and the matrix resin may contain other additives, such as conductive particles.

Examples of the conductive particles include particles of metals such as gold, silver, and copper, and particles of carbon black, titanium oxide, zinc oxide, tin oxide, barium sulfate, aluminum borate, and potassium titanate.

In order to cover the surface of the core with the coating resin, for example, a method may be used, which involves using a coating-layer-forming solution prepared by dissolving the coating resin and, if needed, various additives in an appropriate solvent. The solvent is not particularly limited and may be selected by considering the coating resin used, the suitability of application, etc.

Specific examples of the resin coating method include a dipping method involving dipping cores in the coating-layer-forming solution, a spraying method involving spraying the coating-layer-forming solution onto core surfaces, a fluid bed method involving spraying a coating-layer-forming solution while having the cores float on a bed of air, and a kneader coater method involving mixing cores serving as carriers and a coating-layer-forming solution in a kneader coater and removing the solvent.

In a two-component developer, the toner-to-carrier mixing ratio (mass ratio) is preferably 1:100 to 30:100 and is more preferably 3:100 to 20:100.

Image Forming Apparatus and Image Forming Method

The image forming apparatus and the image forming method of this exemplary embodiment will now be described.

An image forming apparatus according to the exemplary embodiment includes an image carrier; a charging unit that charges a surface of the image carrier; an electrostatic charge image-forming unit that forms an electrostatic charge image on the charged surface of the image carrier; a developing unit that contains an electrostatic charge image developer and develops the electrostatic charge image on the surface of the image carrier by using the electrostatic charge image developer so as to form a toner image; a transfer unit that transfers the toner image on the surface of the image carrier onto a surface of a recording medium; and a fixing unit that fixes the toner image on the surface of the recording medium. The electrostatic charge image developer of the exemplary embodiment is used as the aforementioned electrostatic charge image developer.

An image forming method (the image forming method of the exemplary embodiment) is performed by using the image forming apparatus of the exemplary embodiment, the method including a charging step of charging a surface of an image carrier; an electrostatic charge image forming step of forming an electrostatic charge image on the charged surface of the image carrier; a developing step of developing the electrostatic charge image on the surface of the image carrier by using the electrostatic charge image developer of the exemplary embodiment so as to form a toner image; a transferring step of transferring the toner image on the surface of the image carrier onto a surface of a recording medium; and a fixing step of fixing the toner image on the surface of the recording medium.

The image forming apparatus of the exemplary embodiment is applied to a known image forming apparatus, examples of which include a direct transfer type apparatus with which the toner image formed on the surface of the image carrier is directly transferred to the recording medium; an intermediate transfer type apparatus with which the toner image formed on the surface of the image carrier is first transferred to a surface of an intermediate transfer body and then the toner image on the surface of the intermediate transfer body is transferred to the surface of the recording medium; an apparatus equipped with a cleaning unit that cleans the surface of the image carrier after the toner image transfer and before charging; and an apparatus equipped with a charge erasing unit that erases the charges on the surface of the image carrier by applying charge erasing light after the toner image transfer and before charging.

In the intermediate transfer type apparatus, the transfer unit includes, for example, an intermediate transfer body having a surface onto which a toner image is to be transferred, a first transfer unit that conducts first transfer of the toner image on the surface of the image carrier onto the surface of the intermediate transfer body, and a second transfer unit that conducts second transfer of the toner image on the surface of the intermediate transfer body onto a surface of a recording medium.

In the image forming apparatus of the exemplary embodiment, for example, a section that includes the developing unit may be configured as a cartridge structure (process cartridge) detachably attachable to the image forming apparatus. A process cartridge equipped with a developing unit containing the electrostatic charge image developer of the exemplary embodiment may be used as this process cartridge.

Although some examples of the image forming apparatus of an exemplary embodiment are described below, these examples are not limiting. Only relevant sections illustrated in the drawings are described, and descriptions of other sections are omitted.

Figure 2:
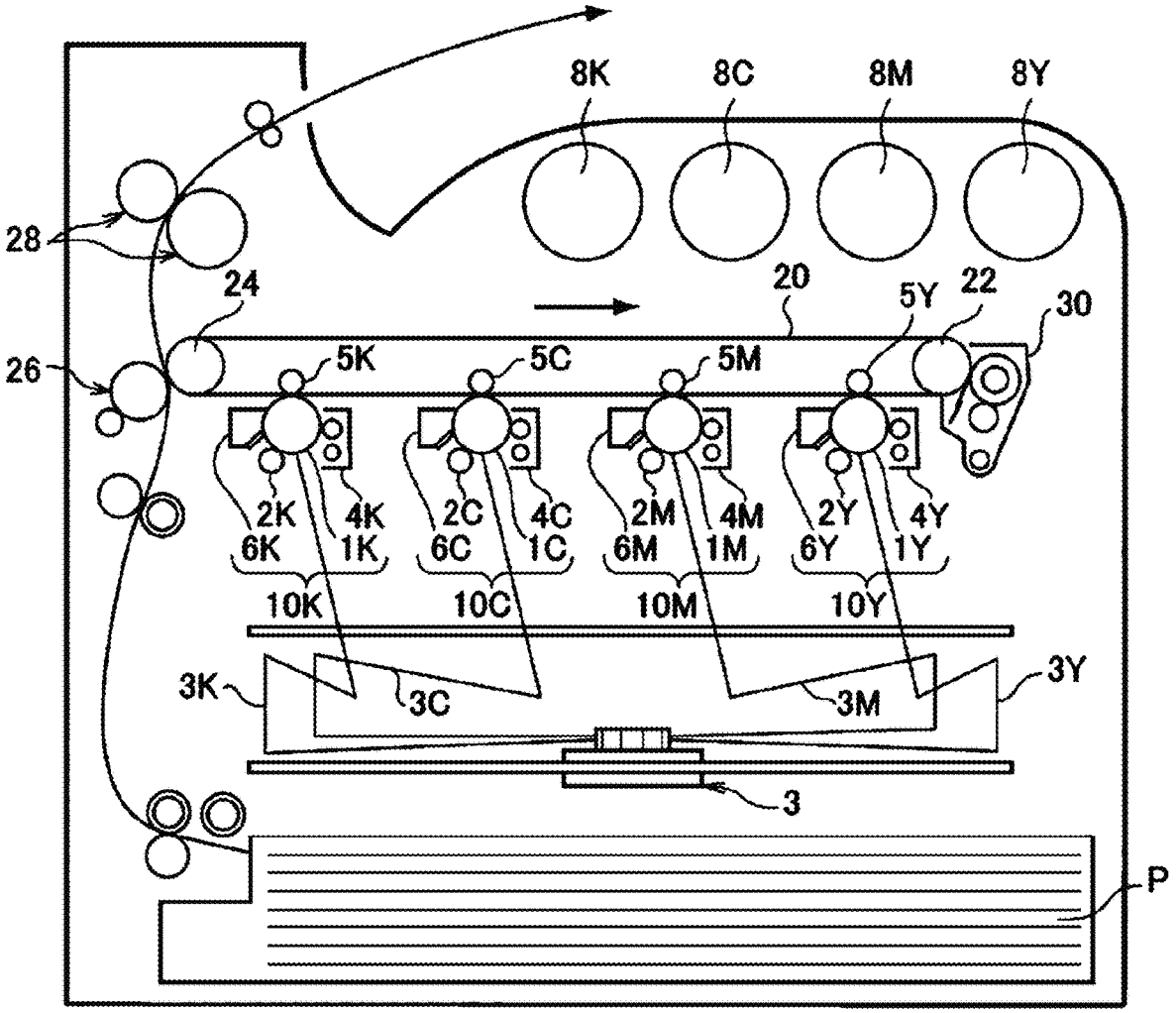
FIG. 2 is a schematic diagram of one example of an image forming apparatus according to an exemplary embodiment.

FIG. 2 is a schematic diagram of an image forming apparatus according to an exemplary embodiment.

An image forming apparatus illustrated in FIG. 2 is equipped with first to fourth electrophotographic image forming units 10Y, 10M, 10C, and 10K (image forming units) that respectively output yellow (Y), magenta (M), cyan (C), and black (K) images on the basis of color-separated image data. These image forming units (hereinafter may be simply referred to as "units") 10Y, 10M, 10C, and 10K are arranged side-by-side with predetermined distances between one another in the horizontal direction. These units 10Y, 10M, 10C, and 10K may each be a process cartridge detachably attachable to the image forming apparatus.

An intermediate transfer belt 20 serving as an intermediate transfer body for all of the units extends above the units 10Y, 10M, 10C, and 10K in the drawing. The intermediate transfer belt 20 is wound around a driving roll 22 and a supporting roll 24, which are spaced from each other in the horizontal direction in the drawing, and runs in a direction from the first unit 10Y to the fourth unit 10K. The supporting roll 24 is in contact with the inner surface of the intermediate transfer belt 20. A force is applied to supporting roll 24 in a direction away from the driving roll 22 by a spring or the like (not illustrated) so that a tension is applied to the intermediate transfer belt 20 wound around these two rolls. An intermediate transfer body cleaning device 30 is installed on the image carrier-side surface of the intermediate transfer belt 20 so as to face the driving roll 22.

Toners including toners of four colors, namely, yellow, magenta, cyan, and black, contained in toner cartridges 8Y, 8M, 8C, and 8K are respectively supplied to developing devices (developing units) 4Y, 4M, 4C, and 4K of the units 10Y, 10M, 10C, and 10K.

Since the first to fourth units 10Y, 10M, 10C, and 10K are identical in structure, the first unit 10Y that forms an yellow image and is disposed on the upstream side in the intermediate transfer belt running direction is described as a representative example. The descriptions of the second to fourth units 10M, 10C, and 10K are omitted by giving an equivalent part of each unit a reference numeral with magenta (M), cyan (C), or black (K) added thereto.

The first unit 10Y has a photoreceptor 1Y that serves as an image carrier. A charging roll (one example of the charging unit) 2Y that charges the surface of the photoreceptor 1Y to a predetermined potential, an exposing device (one example of the electrostatic charge image forming unit) 3 that forms an electrostatic charge image by exposing the charged surface with a laser beam 3Y on the basis of a color-separated image signal, a developing device (one example of the developing unit) 4Y that develops the electrostatic charge image by supplying a charged toner to the electrostatic charge image, a first transfer roll 5Y (one example of the first transfer unit) that transfers the developed toner image onto the intermediate transfer belt 20, and a photoreceptor cleaning device (one example of the cleaning unit) 6Y that removes the toner remaining on the surface of the photoreceptor 1Y after the first transfer are provided around the photoreceptor 1Y.

The first transfer roll 5Y is disposed on the inner side of the intermediate transfer belt 20 and is positioned to face the photoreceptor 1Y. The first transfer rolls 5Y, 5M, 5C, and 5K are respectively connected to bias power supplies (not illustrated) that apply first transfer bias. The transfer bias applied to each first transfer roll from the corresponding bias power supply is controlled by a controller not illustrated in the drawing, and is variable.

Operation of forming a yellow image by using the first unit 10Y will now be described.

Prior to the operation, the surface of the photoreceptor 1Y is charged to a potential of −600 V to −800 V by using the charging roll 2Y.

The photoreceptor 1Y is formed by stacking a photosensitive layer on an electrically conductive (for example, volume resistivity at 20° C.: $1\times10^{-6}$ Ωcm or less) substrate. The photosensitive layer usually has a high resistivity (a resistivity of common resin) but when irradiated with the laser beam 3Y, the resistivity of the portion irradiated with the laser beam changes. The laser beam 3Y is output to the charged surface of the photoreceptor 1Y through the exposing device 3 in accordance with the yellow image data transmitted from the controller (not illustrated). The laser beam 3Y irradiates the photosensitive layer on the surface of the photoreceptor 1Y and an electrostatic charge image of a yellow image pattern is thereby formed on the surface of the photoreceptor 1Y.

An electrostatic charge image is an image formed on the surface of the photoreceptor 1Y by charging. A portion of the photosensitive layer irradiated with the laser bean 3Y undergoes a decrease in resistivity, and, thus, charges on the surface of the photoreceptor 1Y in that portion flow out while charges remain in the rest of the photosensitive layer not irradiated with the laser beam 3Y. Thus, the electrostatic charge image is a negative latent image.

The electrostatic charge image formed on the photoreceptor 1Y is rotated to a predetermined developing position as the photoreceptor 1Y is run. The electrostatic charge image on the photoreceptor 1Y is visualized (developed) with the developing device 4Y at this developing position so as to form a toner image.

An electrostatic charge image developer containing at least a yellow toner and a carrier is contained in the developing device 4Y, for example. The yellow toner is frictionally charged as it is stirred in the developing device 4Y and carried on the developer roll (one example of the developer-carrying member) by having charges having the same polarity (negative) as the charges on the photoreceptor 1Y. As the surface of the photoreceptor 1Y passes the developing device 4Y, the yellow toner electrostatically adheres to the latent image portion on the photoreceptor 1Y from which charges are erased, and the latent image is thereby developed with the yellow toner. The photoreceptor 1Y on which the yellow toner image has been formed is continuously run at a predetermined speed, and the toner image developed on the photoreceptor 1Y is conveyed to a predetermined first transfer position.

After the yellow toner image on the photoreceptor 1Y is conveyed to the first transfer position, a first transfer bias is applied to the first transfer roll 5Y.

Electrostatic force working from the photoreceptor 1Y toward the first transfer roll 5Y also works on the toner image, and the toner image on the photoreceptor 1Y is transferred onto the intermediate transfer belt 20. The transfer bias applied at this time has a polarity opposite to that (negative) of the toner, i.e., the polarity of the transfer bias is positive. For example, the transfer bias for the first unit 10Y is controlled to about +10 μA by the controller (not illustrated).

The toner remaining on the photoreceptor 1Y is removed by the photoreceptor cleaning device 6Y and recovered.

The first transfer bias applied to the first transfer rolls 5M, 5C, and 5K of the second unit 10M and onwards are also controlled as with the first unit.

The intermediate transfer belt 20 onto which the yellow toner image has been transferred by using the first unit 10Y travels through the second to fourth units 10M, 10C, and 10K, and toner images of respective colors are superimposed on the yellow toner image to achieve multiple transfer.

The intermediate transfer belt 20 onto which the toner images of four colors are transferred using the first to fourth units then reaches a second transfer section constituted by the intermediate transfer belt 20, the supporting roll 24 in contact with the intermediate transfer belt inner surface, and the second transfer roll (one example of the second transfer unit) 26 disposed on the image-carrying surface side of the intermediate transfer belt 20. Meanwhile, a recording sheet P (one example of the recording medium) is fed at a predetermined timing through a feeding mechanism to a space where the second transfer roll 26 and the intermediate transfer belt 20 contact each other, and a second transfer bias is applied to the supporting roll 24. The transfer bias applied at this time has the same polarity as the toner (negative). The electrostatic force from the intermediate transfer belt 20 toward the recording sheet P works on the toner image, and the toner image on the intermediate transfer belt 20 is transferred onto the recording sheet P. The second transfer bias is determined by the resistance of the second transfer section detected with a resistance detector (not illustrated) and is controlled by voltage.

Subsequently, the recording sheet P is sent to the contact portion (nip) between a pair of fixing rolls in the fixing device (one example of the fixing unit) 28, and the toner image is fixed onto the recording sheet P to form a fixed image.

Examples of the recording sheet P onto which the toner image is transferred include regular paper used in electrophotographic system copiers and printers. An example of the recording medium other than the recording sheet P is an OHP sheet.

In order to further improve the smoothness of the surface of the image after fixing, the surface of the recording sheet P may be smooth. For example, coated paper which is regular paper having a surface coated with a resin or the like and art paper for printing may be used.

The recording sheet P after fixing of the color image is conveyed toward the discharge unit, and this completes a series of color image forming operations.

Process Cartridge and Toner Cartridge

A process cartridge according to an exemplary embodiment is described.

The process cartridge of the exemplary embodiment is detachably attachable to an image forming apparatus, and includes a developing unit that contains the electrostatic charge image developer of the exemplary embodiment and develops an electrostatic charge image on the surface of the image carrier by using the electrostatic charge image developer so as to form a toner image.

The process cartridge of the exemplary embodiment is not limited to the one having the above-described structure, and may have a structure equipped with a developing device and, if needed, at least one selected from an image carrier, a charging unit, an electrostatic charge image forming unit, and a transfer unit.

One example of the process cartridge of the exemplary embodiment is described below, but this example is not limiting. Only relevant sections illustrated in the drawings are described, and descriptions of other sections are omitted.

Figure 3:
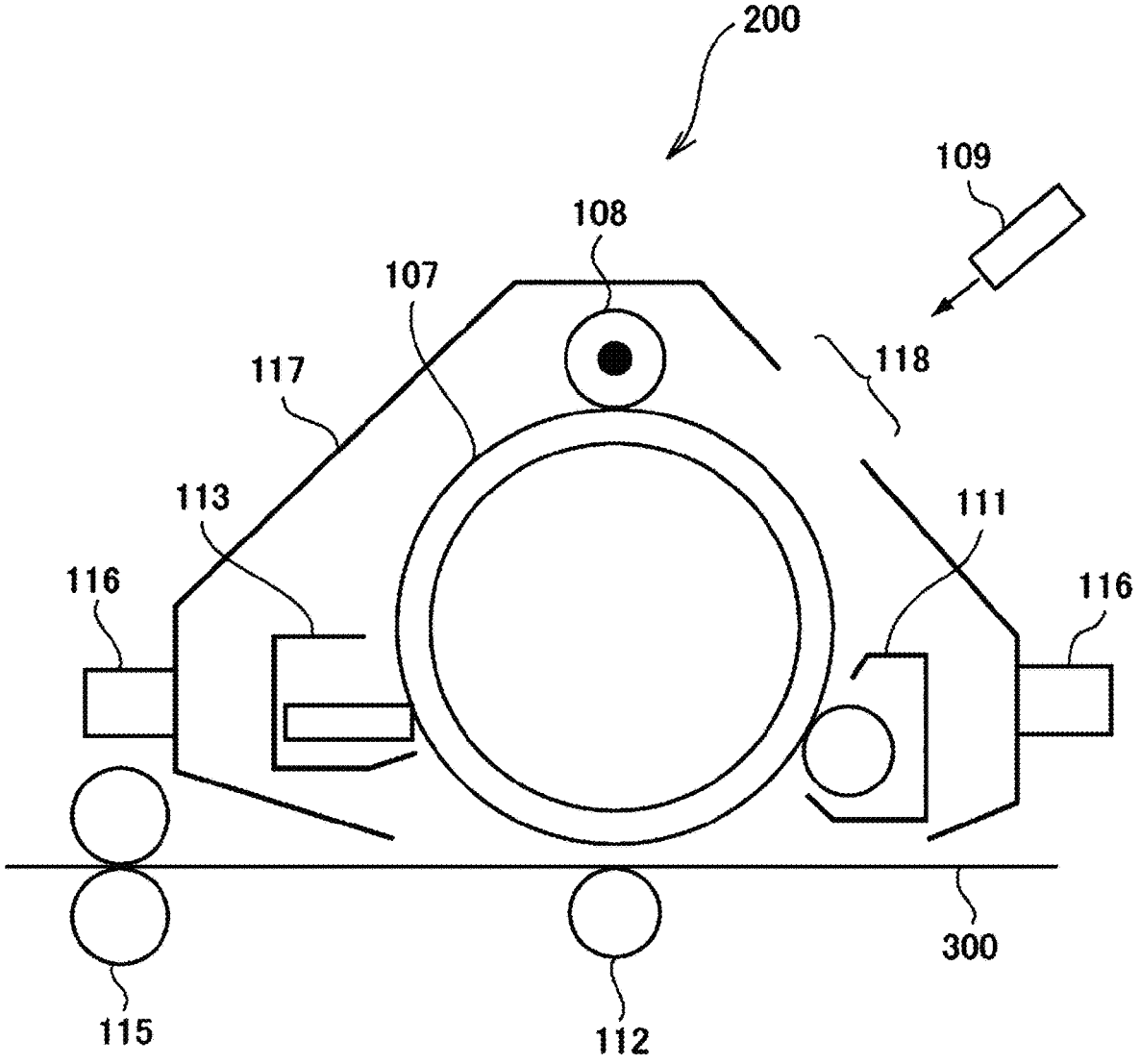
FIG. 3 is a schematic diagram of one example of a process cartridge according to an exemplary embodiment.

FIG. 3 is a schematic diagram of a process cartridge according to the exemplary embodiment.

A process cartridge 200 illustrated in FIG. 3 includes, for example, a photoreceptor 107 (one example of the image carrier), and a charging roll 108 (one example of the charging unit), a developing device 111 (one example of the developing unit), and a photoreceptor cleaning device 113 (one example of the cleaning unit) that are disposed around the photoreceptor 107. A housing 117 having an assembly rail 116 and an opening 118 for exposure combine and integrate the aforementioned components into a cartridge.

In FIG. 3, 109 denotes an exposing device (one example of the electrostatic charge image forming unit), 112 denotes a transfer device (one example of the transfer unit), 115 denotes a fixing device (one example of the fixing unit), and 300 denotes a recording sheet (one example of the recording medium).

Next, a toner cartridge according to an exemplary embodiment is described.

The toner cartridge of the exemplary embodiment is detachably attachable to an image forming apparatus and contains a toner according to an exemplary embodiment. The toner cartridge is for storing refill toners to be supplied to the developing unit disposed inside the image forming apparatus.

The image forming apparatus illustrated in FIG. 2 has detachable toner cartridges 8Y, 8M, 8C, and 8K, and the developing devices 4Y, 4M, 4C, and 4K are respectively connected to the toner cartridges of corresponding colors through toner supply ducts not illustrated in the drawing. When the toner contained in a toner cartridge runs low, the toner cartridge is replaced.

EXAMPLES

Examples of the present disclosure will now be described in further detail, but the present disclosure is not limited by these examples within the limits of the gist of the present disclosure. In the description below, "parts" and "%" are all on a mass basis unless otherwise noted.

Example 1

Synthesis of Crystalline Polyester Resin 1

Into a heated and dried three-necked flask, 225 parts of 1,10-dodecane diacid, 174 parts of 1,10-decanediol, and 0.8 of dibutyltin oxide serving as a catalyst are placed. Then, air inside the three-necked flask is replaced with nitrogen gas to create an inert atmosphere by a depressurizing operation. The resulting mixture is mechanically stirred at 180° C. for 5 hours during which time the reaction is performed under refluxing. During the reaction, water generated in the reaction system is distilled away. Subsequently, at a reduced pressure, the temperature is gradually elevated to 230° C., the mixture is stirred for 2 hours, and, after the mixture has turned viscous, the molecular weight is confirmed by GPC. The distillation at a reduced pressure is stopped when the weight average molecular weight reached 17,500. As a result, a crystalline polyester resin 1 is obtained.

Synthesis of Amorphous Polyester Resin 1

Bisphenol A-propylene oxide adduct: 367 parts
Bisphenol A-ethylene oxide adduct: 230 parts
Terephthalic acid: 163 parts
Trimellitic anhydride: 20 parts
Dibutyltin oxide: 4 parts The above-described components are placed in a heated and dried three-necked flask, the air inside the flask is depressurized by a depressurizing operation, and an inert atmosphere is created by using nitrogen gas. The reaction is then conducted under mechanical stirring at 230° C. and at a normal pressure (101.3 kPa) for 10 hours, and then for 1 hour at 8 kPa. The resulting product is cooled to 210° C., 4 parts of trimellitic anhydride is added to the product, and the reaction is performed for 1 hour. The reaction is continued at 8 kPa until the softening temperature is 118° C., and, as a result, an amorphous polyester resin 1 is obtained.

The softening temperature of the resin is determined by using Flowtester (CFT-5000 produced by Shimadzu Corporation), and is a temperature at which one half of a 1 g sample heated at a temperature elevation rate of 6° C./min and at a load of 1.96 MPa applied by a plunger has flown out as it is pushed out from a nozzle 1 mm in diameter and 1 mm in length.

Synthesis of Amorphous Polyester Resin 2

Bisphenol A-propylene oxide adduct: 469 parts
Bisphenol A-ethylene oxide adduct: 137 parts
Terephthalic acid: 152 parts
Fumaric acid: 20 part
Dibutyltin oxide: 4 parts The above-described components are placed in a heated and dried three-necked flask, the air inside the flask is depressurized by a depressurizing operation, and an inert atmosphere is created by using nitrogen gas. The reaction is then conducted under mechanical stirring at 230° C. and at a normal pressure (101.3 kPa) for 10 hours, and then for 1 hour at 8 kPa. The resulting product is cooled to 210° C., 4 parts of trimellitic anhydride is added to the product, and the reaction is performed for 1 hour. The reaction is continued at 8 kPa until the softening temperature is 107° C., and, as a result, an amorphous polyester resin 2 is obtained.

Preparation of Crystalline Polyester Resin Particle Dispersion 1

A crystalline resin 1 (100 parts), methyl ethyl ketone (40 parts), and isopropyl alcohol (30 parts) are placed in a separable flask, thoroughly stirred at 75° C., and dissolved. Then, 6.0 parts of a 10% aqueous ammonia solution is added thereto dropwise. The heating temperature is decreased to 60° C., and ion exchange water is added thereto dropwise at a liquid feed rate of 6 g/min via a liquid feed pump while the mixture is being stirred. After the mixture has evenly clouded, the liquid feed rate is increased to 25 g/min, and the dropwise addition of ion exchange water is stopped when the total amount of the liquid has reached 400 parts. Subsequently, the solvent is removed at a reduced pressure to obtain a crystalline polyester resin particle dispersion 1. The volume-average particle diameter and the solid concentration of the obtained crystalline polyester resin particle dispersion 1 are, respectively, 168 nm and 11.5%.

Preparation of Amorphous Polyester Resin Particle Dispersion 1

Amorphous polyester resin 1: 300 parts
Methyl ethyl ketone: 218 parts
Isopropanol: 60 parts
10% aqueous ammonia solution: 10.6 parts The above-described components (for the amorphous polyester resin, insoluble components are removed beforehand) are placed in a separable flask, mixed, and dissolved. Subsequently, while the resulting mixture is being heated and stirred at 40° C., ion exchange water is added thereto dropwise via a liquid feed pump at a liquid feed rate of 8 g/min. After the liquid has clouded, the liquid feed rate is increased to 12 g/min to induce phase inversion, and the dropwise addition is stopped when the amount of the fed liquid has reached 1050 parts. Subsequently, the solvent is removed at a reduced pressure, and an amorphous polyester resin particle dispersion 1 is obtained as a result. The volume-average particle diameter and the solid concentration of the amorphous polyester resin particle dispersion 1 are, respectively, 168 nm and 30%.

Preparation of Amorphous Polyester Resin Particle Dispersion 2

Amorphous polyester resin 2: 300 parts
Methyl ethyl ketone: 150 parts
Isopropanol: 50 parts
10% aqueous ammonia solution: 10.6 parts The above-described components (for the amorphous polyester resin, insoluble components are removed beforehand) are placed in a separable flask, mixed, and dissolved. Subsequently, while the resulting mixture is being heated and stirred at 40° C., ion exchange water is added thereto dropwise via a liquid feed pump at a liquid feed rate of 8 g/min. After the liquid has clouded, the liquid feed rate is increased to 12 g/min to induce phase inversion, and the dropwise addition is stopped when the amount of the fed liquid has reached 1050 parts. Subsequently, the solvent is removed at a reduced pressure, and an amorphous polyester resin dispersion 2 is obtained as a result. The volume-average particle diameter and the solid concentration of the amorphous polyester resin particle dispersion 2 are, respectively, 170 nm and 30%.

Vinyl/Amorphous Polyester Composite Resin Particle Dispersion 1

Amorphous polyester resin particle dispersion 2: 160 parts

Butyl acrylate: 192 parts

10% aqueous ammonia solution: 3.6 parts

The above-described components and 253 parts of ion exchange water are placed in a 2 L cylindrical stainless steel container, and dispersed and mixed in a homogenizer (ULTRA-TURRAX T50 produced by IKA Japan) for 10 minutes at a number of rotation of 10,000 rpm Subsequently, the raw material dispersion is transferred to a polymerization vessel equipped with a thermometer and a stirring device that uses a two-paddle stirring blade, and heated with a heating mantle under a nitrogen atmosphere at stirring rotation rate of 200 rpm. Then the temperature of 75° C. is retained for 30 minutes. Subsequently, a liquid mixture containing 1.8 parts of potassium persulfate and 120 parts of ion exchange water is added dropwise via a liquid feed pump for 120 minutes, and then the temperature is retained at 75° C. for 210 minutes. After the liquid temperature is decreased to 50° C., 5.4 parts of an anionic surfactant (DOWFAX 2A1 produced by The Dow Chemical Company) is added to the mixture so as to obtain a vinyl/amorphous polyester composite resin particle dispersion 1, which is a particle dispersion of the vinyl/amorphous polyester composite resin 1. The volume-average particle diameter and the solid concentration of the obtained vinyl/amorphous polyester composite resin particle dispersion 1 are, respectively, 220 nm and 32%.

In the vinyl/amorphous polyester composite resin particle dispersion 1, the glass transition temperature Tg of the vinyl resin constituting the coating layer is lower than the temperature (150° C.) of the fixing device in "Evaluation/image roughening" described below.

Preparation of Releasing Agent Dispersion

Paraffin wax HNP9 (produced by Nippon Seiro Co., Ltd.): 500 parts

Anionic surfactant (DOWFAX 2A1 produced by The Dow Chemical Company): 50 part

Ion exchange water: 1700 parts

The above-described materials are heated to 110° C. and dispersed in a homogenizer (ULTRA-TURRAX T50 produced by IKA Japan). The resulting dispersion is then dispersed in a Manton-Gaulin high-pressure homogenizer (produced by Gaulin Company) to prepare a releasing agent dispersion 1 (solid concentration: 32%) containing a dispersed releasing agent particles having an average particle size of 180 nm.

Preparation of Cyan Pigment Dispersion

Pigment Blue 15:3 (DIC Corporation): 200 parts

Anionic surfactant (DOWFAX 2A1 produced by The Dow Chemical Company): 1.5 parts

Ion exchange water: 800 parts

The above-described materials are mixed and dispersed in a disperser machine CAVITRON (CR1010 produced by Pacific Machinery & Engineering Co., Ltd.) for about 1 hour. As a result, a cyan pigment dispersion (solid concentration: 20%) is obtained.

Preparation of Cyan Toner 1

Amorphous polyester resin particle dispersion 1: (amount indicated in Table 2)

Vinyl/amorphous polyester composite resin particle dispersion 1: (amount indicated in Table 2)

Crystalline polyester resin particle dispersion 1: (amount indicated in Table 2)

Releasing agent dispersion 1: 45 parts

Cyan pigment dispersion: 90 parts

Anionic surfactant (DOWFAX 2A1 produced by The Dow Chemical Company): 1.40 parts The above-described materials are placed in a 2 L cylindrical stainless steel container, and dispersed and mixed in a homogenizer (ULTRA-TURRAX T50 produced by IKA Japan) for 10 minutes at 4000 rpm while applying shear force. Next, 1.75 parts of a 10% aqueous nitric acid solution of polyaluminum chloride serving as an aggregating agent is gradually added thereto dropwise, and the resulting mixture is dispersed and mixed for 15 minutes by setting the number of rotation of the homogenizer to 5,000 rpm. As a result, a raw material dispersion is obtained.

Subsequently, the raw material dispersion is transferred to a polymerization vessel equipped with a thermometer and a stirring device that uses a two-paddle stirring blade, and heated with a heating mantle at a stirring rotation rate of 550 rpm so as to accelerate growth of aggregated particles at 49° C. During this process, the pH of the raw material dispersion is controlled to be within the range of 2.2 to 3.5 by using 0.3 M nitric acid or a 1 M aqueous sodium hydroxide solution. The dispersion is retained within the pH range described above for about 2 hours to form aggregated particles.

Thereto, 184 parts of the amorphous polyester resin particle dispersion 1 is further added to attach the resin particles of the binder resin to the surfaces of the aggregated particles. The temperature is further elevated to 53° C., and the aggregated particles are adjusted by monitoring the size and morphology of the particles by using an optical microscope and Multisizer II. Subsequently, the pH is adjusted to 7.8 by using a 5% aqueous sodium hydroxide solution. This state is maintained for 15 minutes. The pH is then raised to 8.0 to fuse the aggregated particles, and then the temperature is increased to 85° C. After confirming the fusion of the aggregated particles with an optical microscope, heating is stopped after 2 hours, and the mixture is cooled at a rate of 1.0° C./min. The resulting product is screened with a 20 μm mesh, repeatedly washed with water, and dried in a vacuum drier to obtain cyan toner particles 1.

To the obtained cyan toner particles 1, 0.5% of silica (average particle size: 40 nm) treated with hexamethyldisilazane and 0.7% of a titanium compound (average particle size: 30 nm) obtained by firing metatitanic acid, 50% of which has been treated with isobutyltrimethoxysilane, are added as external additives (% here is the mass ratio relative to the toner particles). The resulting mixture is mixed for 10 minutes in a 75 L Henschel mixer and screened through an air screener HI-BOLTER 300 (produced by Shin Tokyo Kikai KK.) to prepare a cyan toner 1. The volume-average particle diameter of the obtained cyan toner 1 is 5.8 μm.

For each of the obtained amorphous polyester resins 1 and 2 and the vinyl/amorphous polyester composite resin 1, the storage modulus G' at 50° C., the storage modulus G' at 100° C., and tan δ in the entire temperature range of 50° C. or more and 100° C. or less are measured by the aforementioned methods. For the vinyl/amorphous polyester composite resin 1, the storage modulus G' in the entire temperature range of 50° C. or more and 100° C. or less and the tetrahydrofuran insoluble fraction content are also measured. The results are indicated in Table 1.

For the obtained cyan toner particles 1, whether there are a continuous phase and a discontinuous phase having a core and a coating layer, the average equivalent circle diameter L1 [nm] of the discontinuous phase, and the average thickness L2 [nm] of the coating layer" are confirmed or measured by the aforementioned methods. The results are indicated in Table 3.

For the obtained cyan toner 1, the storage modulus $G'_{50T}$ at 50° C., the storage modulus $G'_{100T}$ at 100° C., and tan $\delta_T$ in the entire temperature range of 50° C. or more and 100° C. or less are measured by the aforementioned methods. For the contained materials other than the vinyl/amorphous polyester composite resin 1, the storage modulus $G'_{50r}$ at 50° C. and the storage modulus $G'_{100r}$ at 100° C. are measured by the aforementioned methods. The results are indicated in Table 3.

Preparation of Cyan Developer 1

Next, to 100 parts of a ferrite core having an average particle diameter of 35 μm, 0.15 parts of vinylidene fluoride and 1.35 parts of a methyl methacrylate-trifluoroethylene copolymer (polymerization ratio: 80:20) resin are added to coat the core by using a kneader so as to prepare a carrier. In a 2 L V-blender, 100 parts of the obtained carrier and 8 parts of the cyan toner 1 are mixed to prepare a cyan developer 1.

Preparation of Cyan Toners 2 to 11, B1, and B2 and Developers 2 to 11, B1, and B2

Cyan toners 2 to 11, B1, and B2 and cyan developers 2 to 11, B1, and B2 are prepared as with the cyan toner 1 and the cyan developer 1 except that the types and amounts of the dispersions used are changed as indicated in Table 2.

TABLE 1

| | G' at 50° C. | G' at 100° C. | Tan δ in 50 to 100° C. | G' in 50 to 100° C. | THF insoluble fraction content [mass %] |
|---|---|---|---|---|---|
| Amorphous polyester resin 1 | $5.3 \times 10^8$ | $2.7 \times 10^4$ | 0.01 to 3.35 | — | — |
| Amorphous polyester resin 2 | $6.5 \times 10^8$ | $1.3 \times 10^4$ | 0.01 to 3.12 | — | — |
| Vinyl/amorphous polyester composite resin 1 | $8.1 \times 10^4$ | $6.6 \times 10^4$ | 0.11 to 0.40 | $6.6 \times 10^4$ to $8.1 \times 10^4$ | 95.4 |

TABLE 2

| Cyan toner | Cyan toner particles | Amorphous polyester resin particle dispersion 1 Added amount [parts] | Crystalline polyester resin particle dispersion 1 Added amount [parts] | Vinyl/amorphous polyester composite resin particle dispersion 1 Added amount [parts] |
|---|---|---|---|---|
| 1 | 1 | 129 | 261 | 138 |
| 2 | 2 | 203 | 278 | 63 |
| 3 | 3 | 76 | 209 | 206 |
| 4 | 4 | 196 | 104 | 131 |
| 5 | 5 | 83 | 365 | 144 |
| 6 | 6 | 169 | 243 | 106 |
| 7 | 7 | 143 | 348 | 94 |
| 8 | 8 | 256 | 104 | 75 |
| 9 | 9 | 56 | 296 | 194 |
| 10 | 10 | 116 | 35 | 231 |
| 11 | 11 | 89 | 522 | 81 |
| B1 | B1 | 169 | 539 | — |
| B2 | B2 | 236 | 365 | — |

TABLE 3

| | Cyan developer | Whether a continuous phase and a discontinuous phase having a core and a coating layer are present | Discontinuous phase equivalent circle diameter L1 [nm] | Coating layer thickness L2 [nm] | Toner 50° C. $G'_{50T}$ | Toner 100° C. $G'_{100T}$ | Toner 50 to 100° C. $\tan\delta_T$ |
|---|---|---|---|---|---|---|---|
| Example 1 | 1 | YES | 241 | 31 | $7.4 \times 10^7$ | $4.1 \times 10^4$ | 0.07 to 0.37 |
| Example 2 | 2 | YES | 239 | 24 | $2.2 \times 10^8$ | $5.1 \times 10^4$ | 0.09 to 0.64 |
| Example 3 | 3 | YES | 227 | 28 | $3.1 \times 10^6$ | $3.2 \times 10^4$ | 0.13 to 0.54 |
| Example 4 | 4 | YES | 255 | 26 | $1.2 \times 10^8$ | $6.7 \times 10^5$ | 0.12 to 0.66 |
| Example 5 | 5 | YES | 247 | 27 | $7.1 \times 10^7$ | $1.4 \times 10^4$ | 0.08 to 0.61 |
| Example 6 | 6 | YES | 231 | 31 | $8.1 \times 10^7$ | $3.5 \times 10^4$ | 0.11 to 0.75 |
| Example 7 | 7 | YES | 220 | 40 | $7.6 \times 10^7$ | $3.4 \times 10^4$ | 0.13 to 1.21 |
| Example 8 | 8 | YES | 237 | 26 | $2.8 \times 10^8$ | $2.6 \times 10^4$ | 0.11 to 0.97 |
| Example 9 | 9 | YES | 221 | 27 | $2.5 \times 10^6$ | $3.1 \times 10^4$ | 0.09 to 0.81 |
| Example 10 | 10 | YES | 249 | 34 | $5.4 \times 10^7$ | $2.4 \times 10^5$ | 0.08 to 0.53 |

TABLE 3-continued

| | | | | | | | |
|---|---|---|---|---|---|---|---|
| Example 11 | 11 | YES | 246 | 31 | $3.7 \times 10^7$ | $1.2 \times 10^4$ | 0.12 to 1.34 |
| Comparative Example 1 | B1 | NO | — | — | $1.1 \times 10^8$ | $1.7 \times 10^4$ | 0.09 to 1.59 |
| Comparative Example 2 | B2 | NO | — | — | $2.1 \times 10^7$ | $7.5 \times 10^5$ | 0.03 to 0.41 |

| | Materials contained in toner other than vinyl/amorphous polyester resin composite resin particles 1 | | Evaluation |
|---|---|---|---|
| | 50° C. $G'_{50r}$ | 100° C. $G'_{100r}$ | Image roughening |
| Example 1 | $1.4 \times 10^8$ | $6.7 \times 10^3$ | A |
| Example 2 | $1.3 \times 10^8$ | $7.1 \times 10^3$ | B |
| Example 3 | $1.4 \times 10^8$ | $6.3 \times 10^3$ | B |
| Example 4 | $4.2 \times 10^8$ | $3.1 \times 10^4$ | B |
| Example 5 | $8.4 \times 10^7$ | $2.4 \times 10^3$ | B |
| Example 6 | $1.9 \times 10^8$ | $7.3 \times 10^3$ | B |
| Example 7 | $8.7 \times 10^7$ | $5.7 \times 10^3$ | B |
| Example 8 | $1.1 \times 10^9$ | $3.6 \times 10^4$ | C |
| Example 9 | $2.4 \times 10^6$ | $3.7 \times 10^3$ | C |
| Example 10 | $7.4 \times 10^8$ | $1.7 \times 10^5$ | C |
| Example 11 | $4.5 \times 10^6$ | $9.1 \times 10^2$ | C |
| Comparative Example 1 | $1.1 \times 10^8$ | $1.7 \times 10^4$ | D |
| Comparative Example 2 | $2.1 \times 10^7$ | $7.5 \times 10^5$ | D |

Evaluation/Image Roughening

An image forming apparatus (product name: Docu Print C2450 II produced by Fuji Xerox Co., Ltd.) is tuned so that there is a difference in rotation rate between two sheet conveying rolls respectively disposed at two ends of a paper sheet immediately upstream of the fixing member in the sheet conveying direction (two ends in a direction orthogonal to the sheet conveying direction). Specifically, the rotation rate of one of the sheet conveying rolls is set to 70.2 m/s, and that of the other is set to 69.8 m/s.

The cyan developer indicated in Table 3 is loaded into this image forming apparatus, and an all-solid image having a toner load amount adjusted to 10.0 g/cm$^2$ is formed as an evaluation chart. This image is printed out on 100 sheets without break in an environment having a temperature of 25° C. and a humidity of 90%. The 100th image is evaluated in terms of image roughening according to the evaluation standard below. The area of the image in the sheet of paper is 30%, the temperature of the fixing device is 150° C., and the sheet of paper used is A3 SP paper having a basis weight of 60 g/m$^2$ (produced by Fuji Xerox Co., Ltd.).

A: No image roughening is found.

B: Image roughening is barely recognizable with naked eye.

C: Slight image roughening is found but the level thereof is acceptable.

D: Clear image roughening is recognizable, and the level thereof is unacceptable.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for developing an electrostatic charge image, the toner comprising a binder resin, wherein:

in dynamic viscoelasticity measurement, a storage modulus $G'_{50T}$ of the toner at 50° C. is $2\times10^6$ Pa or more and $3\times10^8$ Pa or less, a storage modulus $G'_{100T}$ of the toner at 100° C. is $1\times10^4$ Pa or more and $1\times10^6$ Pa or less, and tan $\delta_T$ of the toner in an entire temperature range of 50° C. or more and 100° C. or less is 0.05 or more and 1.5 or less.

2. The toner according to claim 1, wherein:

the binder resin includes a crystalline resin A, an amorphous resin B1, and an amorphous resin B2;

in dynamic viscoelasticity measurement, tan $\delta_{B2}$ of the amorphous resin B2 in the entire temperature range of 50° C. or more and 100° C. or less is less than 1, and a storage modulus $G'_{50\text{-}100B2}$ of the amorphous resin B2 in the entire temperature range of 50° C. or more and 100° C. or less is $1\times10^3$ Pa or more and $1\times10^7$ Pa or less; and a tetrahydrofuran insoluble fraction content of the amorphous resin B2 is 90 mass % or more and 100 mass % or less.

3. The toner according to claim 2, wherein:

in dynamic viscoelasticity measurement, a storage modulus $G'_{50R}$ of materials contained in the toner other than the amorphous resin B2 at 50° C. is $3\times10^6$ Pa or more and $9\times10^8$ Pa or less, and a storage modulus $G'_{100R}$ of the materials contained in the toner other than the amorphous resin B2 at 100° C. is $1\times10^3$ Pa or more and $1\times10^5$ Pa or less.

4. The toner according to claim 2, wherein the crystalline resin A is a crystalline polyester resin, and the amorphous resin B1 is an amorphous polyester resin.

5. An electrostatic charge image developer comprising the toner for developing an electrostatic charge image according to claim 1.

6. A toner cartridge detachably attachable to an image forming apparatus, the toner cartridge comprising the toner for developing an electrostatic charge image according to claim 1.

* * * * *